US005338018A

United States Patent [19]

Nagao et al.

[11] Patent Number: 5,338,018

[45] Date of Patent: Aug. 16, 1994

[54] AUTOMATIC DOCUMENT FEEDER

[75] Inventors: Tsuyoshi Nagao; Masayuki Kakuta; Yasuhiko Kida; Yoshiyuki Takeda; Takeshi Yoshida, all of Osaka, Japan

[73] Assignee: Mita Industrial Co., Ltd., Osaka, Japan

[21] Appl. No.: 69,575

[22] Filed: Jun. 1, 1993

[30] Foreign Application Priority Data

Jun. 2, 1992 [JP] Japan ..... 4-141783

[51] Int. Cl.[5] ..... B65H 3/00; B65H 29/00

[52] U.S. Cl. ..... 271/3; 271/273; 355/75; 355/231

[58] Field of Search ..... 355/75, 231; 271/3, 271/273, 274

[56] References Cited

U.S. PATENT DOCUMENTS 4,314,006 2/1982 Lentz ..... 271/3 X 4,439,036 3/1984 Davis ..... 355/231 X 4,520,977 6/1985 Holzhauser ..... 355/231 X 5,110,103 5/1992 Miyoshi ..... 271/3

*Primary Examiner*—Richard A. Schacher

*Attorney, Agent, or Firm*—Antonelli, Terry, Stout & Kraus

[57] ABSTRACT

In the ADF of this invention, not only the conveying unit but also at least one of the paper feeding unit and the paper discharging unit are supported by a support frame via floating support mechanisms. The conveying unit and either one of the paper feeding unit and the paper discharging unit are provided with a plurality of contact pieces that come in contact with the platen glass and with the housing at the closed position of the support frame or the ADF. The load of either the paper feeding unit or the paper discharging unit is supported by said contact pieces at the closed position of the ADF.

9 Claims, 17 Drawing Sheets

AUTOMATIC DOCUMENT FEEDER

FIELD OF THE INVENTION

The present invention relates to an automatic document feeder that is employed for an image processing machine such as an electrostatic copying machine or an image reader.

DESCRIPTION OF THE PRIOR ART

A platen glass is provided on the upper surface of a housing of an image processing machine such as an electrostatic copying machine. On the upper surface of the housing is further mounted an automatic document feeder (hereinafter referred to as ADF). In the conventional ADFs with which the present invention is concerned, in general, the rear side of the electrostatic copying machine is supported by the housing via a hinge means in a manner of being opened and closed, and the central portion of the front side of the electrostatic copying machine is detachably attached to the housing by means of, for example, a magnet catch. The ADF is further equipped with a support frame which is so supported via a hinge means as to be pivoted between a closed position and an open position (i.e., between the closed position and the open position of the ADF) with respect to the platen glass provided on the housing, a paper feeding unit that is firmly supported at one end of the support frame (on the left side of the electrostatic copying machine), a paper discharging that is unit firmly supported at the other end of the support frame (on the right side of the electrostatic copying machine), a conveying unit supported between the above-mentioned units of the support frame via a floating support means, and a stopper that is provided at a lower portion of the conveying unit so as to come in contact with the platen glass at the closed position. The conveying unit is equipped with a front side frame and a rear side frame that are disposed, spaced at a distance, at the front and the rear, a support member that couples the above frames together, and a conveying belt mechanism disposed between the above frames. The floating support means is provided between the support frame and the conveying unit, and includes a spring which urges the conveying unit toward the platen glass. When the ADF is turned from the open position to the closed position, the front side is mounted on the housing by the magnet catch (attracting mechanism made up of a permanent magnet). At this closed position, the stopper of the conveying unit comes into contact with the platen glass. In this case, the spring is compressed by a predetermined amount, and the conveying unit is urged toward the platen glass. The above-mentioned ADF in which the conveying unit is supported in a floating manner has been disclosed in, for example, Japanese Laid-Open Patent Publication No. 310,229/1990.

In the above-mentioned conventional ADF, the conveying unit is supported by the support frame via a floating support means, in an attempt to prevent the papers from being fed or discharged in a tilted manner. That is, this is because a uniform gap is maintained between the surface of the platen glass and the surface of the belt of the conveying belt mechanism even when the ADF as a whole is deflected due to cantilevered support by the hinge means. It cannot be said, however, that the above attempt has been sufficiently reliably accomplished. In the above ADF, the conveying unit is supported on the support frame via the floating support means, but the paper feeding unit and the paper discharging unit are firmly supported at both ends of the support frame. In addition, the ADF is supported on the housing at the central portion of its front side by means of the magnet catch. That is, the rear part of the support frame is supported by the housing via the hinge means, and the central portion of the front edge of the support frame in the right-and-left direction is supported on the housing by means of the magnet catch. However, the support frame is not supported on both sides of the magnet catch, leaving a very unstable factor in regard to supporting the load. Besides, when the paper feeding unit and the paper discharging unit are heavy, or when their weights are out of balance to a great degree, a moment due to the out-of-balance at the magnet catch as a fulcrum acts upon the front edge of the support frame, and the support frame is easily deflected. Due to the weights of the paper feeding unit and the paper discharging unit and due to the imbalance thereof, therefore, both sides of the support frame where the above units are located may be downwardly deflected and, particularly, the front portion of the support frame which is remote from the hinge means and on which the relatively heavy paper feeding unit is mounted may be downwardly deflected to become lower than a predetermined height. This tendency appears conspicuously when the ADF that includes such units has large lengths in the back-and-forth direction and in the right-and-left direction. When the ADF as a whole is thus deflected, the lower surfaces of the units may locally become higher or lower than a reference position, making it difficult to maintain predetermined proper posture and causing the paper to be fed and discharged in a tilted manner. As the papers are fed and discharged in a tilted manner, it becomes difficult to transfer the image onto a predetermined proper position of the copying paper. Moreover, jams take place frequently and the life of the ADF as a whole is shortened as well.

SUMMARY OF THE INVENTION

The principal object of the present invention is to provide an automatic document feeder, in which the support frame is reliably prevented from such deflections mentioned above and consequently, not only the conveying unit but also the whole units inclusive of the paper feeding unit and the paper discharging unit can be maintained in a predetermined proper posture at all times at the closed position.

The other objects of the present invention will become apparent from the following description of the embodiments of the ADF constituted according to the present invention in conjunction with the accompanying drawings.

According to one aspect of the present invention, there is provided an automatic document feeder comprising a support frame that is so supported via a hinge means as to be pivoted between the closed position and the open position with respect to a platen glass provided on a housing, a paper feeding unit that is supported at one end of said support frame, a paper discharging unit that is supported at the other end of said support frame, and a conveying unit that is supported between said units of said support frame via a floating support means, said conveying unit being provided with a spacer means that comes in contact with said platen glass at the closed position, the improvement wherein at least one of said paper feeding unit and said paper discharging unit is supported by said support frame via a floating support means, and either one of said paper feeding unit and said paper discharging unit is provided with a spacer means that comes in contact with said housing at the closed position.

According to another aspect of the present invention, there is provided an automatic document feeder comprising a support frame that is so supported via a hinge means as to be pivoted between the closed position and the open position with respect to a platen glass provided on a housing, a paper feeding unit that is disposed at one end of said support frame, a paper discharging unit that is disposed at the other end of said support frame, and a conveying unit that is supported between said units of said support frame via a floating support means, said conveying unit being provided with a front side frame and a rear side frame disposed, spaced at a distance, at the front and the rear, a support member that couples said frames together, a conveying belt mechanism disposed between said frames, and a spacer means that comes in contact with said platen glass at the closed position, the improvement wherein said paper feeding unit and said paper discharging unit are firmly supported on said front side frame and on said rear side frame of said conveying unit.

According to a further aspect of the present invention, there is provided an automatic document feeder comprising a support frame that is so supported via a hinge means as to be pivoted between the closed position and the open position with respect to a platen glass provided on a housing, a paper feeding unit that is firmly supported at one end of said support frame, a paper discharging unit that is firmly supported at the other end of said support frame, and a conveying unit that is supported between said units of said support frame via a floating support means, said conveying unit being provided with a spacer means that comes in contact with said platen glass at the closed position, the improvement wherein at least one of said paper feeding unit and said paper discharging unit is provided with a spacer means at a lower portion thereof on the side opposite to said hinge means, said spacer means coming in contact with said housing at the closed position.

DETAILED DESCRIPTION OF THE PREFERRED EMBODIMENTS

Figure 1:
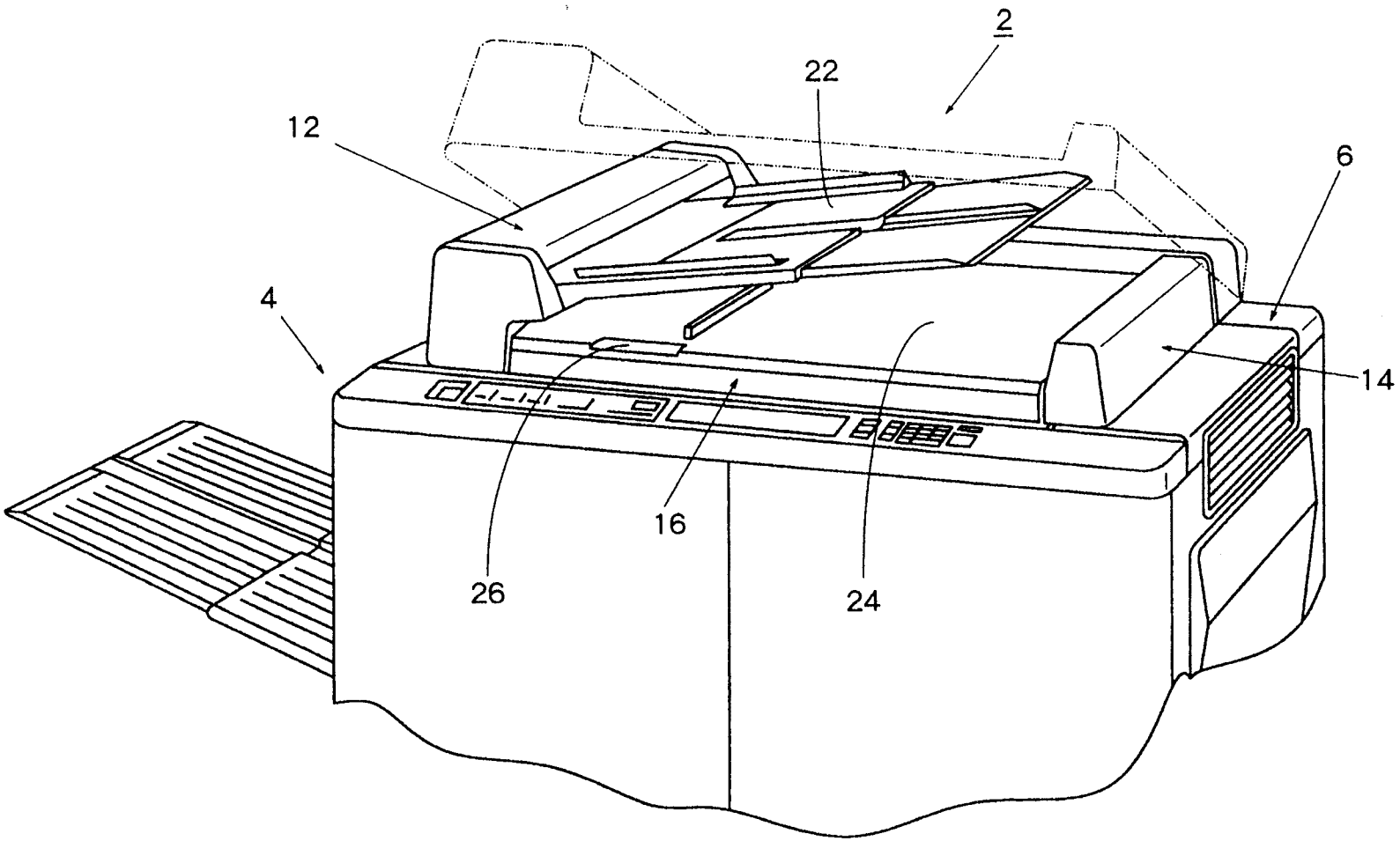
FIG. 1 is a perspective view which schematically shows the condition where an ADF constituted according to one aspect of the present invention is mounted on an electrostatic copying machine.

Embodiments of the ADF constituted according to the present invention will now be described in detail in conjunction with the accompanying drawings wherein the common portions are denoted by the same reference numerals.

Figure 2:
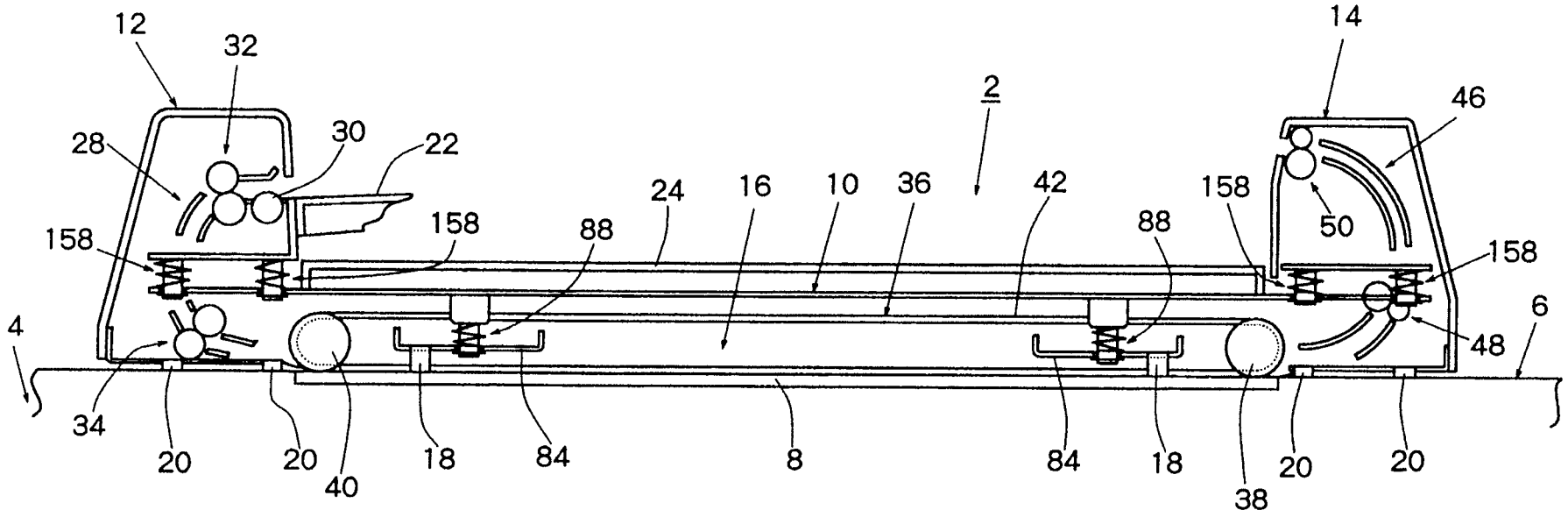
FIG. 2 is a drawing which schematically illustrates the ADF of FIG. 1 in the right-and-left direction in cross section and conceptually shows one aspect of the present invention.

First, an embodiment of the ADF constituted according to one aspect of the present invention will be described by reference to FIGS. 1 to 15. Referring to FIGS. 1 and 2, the ADF which is generally designated at 2 is applied to an electrostatic copying machine 4. In this specification, the front side stands for the front side of the electrostatic copying machine 4 shown in FIG. 1; the rear side, the back side of the same, the left side, the left side of the same; and the right side, the right side of the same. The electrostatic copying machine 4 has a housing 6 of a rectangular parallelepiped shape, and a platen glass 8 is mounted on the upper surface of the housing 6. The document to be copies is placed at a required position on the platen glass 8. The electrostatic copying machine 4 itself may be of a widely-known type and is not described here. The ADF 2 is provided with a support frame 10 which will be detailedly described later, a paper feeding unit 12 supported at one end of the support frame 10 (left side in the drawing), a paper discharging unit 14 supported at the other end of the support frame 10 (right side in the drawing), and a conveying unit 16 that is supported between the above units 12 and 14 on the support frame 10 via a floating support means, which will be described later. The support frame 10 is supported via a hinge mechanism 68 that will be mentioned later and is provided on the rear side of the electrostatic copying machine 4, so as to be pivoted between a closed position indicated by solid lines and an open position indicated by two-dot chain lines with respect to the platen glass 8. The conveying unit 16 is provided with four contact pieces 18 which are spacer means that come in contact with the upper surface of the platen glass 8 at the closed position. At least either the paper feeding unit 12 or the paper discharging unit 14 is supported by the support frame 10 via the floating support means that will be described later. Either the paper feeding unit 12 or the paper discharging unit 14 is provided with a plurality of contact pieces 20 which are spacer means that come in contact with the housing 6 at the closed position of the ADF.

The paper feeding unit 12, the paper discharging unit 14 and the conveying unit 16 are so constituted as will be respectively entirely covered by a covering of synthetic resin. On the right side of the paper feeding unit 12 is provided a document placing plate 22 on which will be placed a document that is to be fed to the paper feeding unit 12. The upper surface of the covering which covers mainly the upper portion and the front and rear side portions of the conveying unit 16 that is positioned under the document placing plate 22 is flat, and constitutes a document receiving plate 24 that receives the document discharged from the paper discharging unit 14. A grip 26 is formed at an upper portion of front edge of the covering of the conveying unit 16. The grip 26 will be held by hand to turn the ADF 2 between the closed position indicated by solid lines and the open position indicated by two-dot chain lines in FIG. 1. A magnet means that will be described later is provided between a lower portion of front edge of the covering of the conveying unit 16 (specifically speaking, the same portion of the support frame 10) and the corresponding upper portion of front edge of the housing 6, so that the ADF 2 is locked at the closed position. That is, the magnet means is provided at one central portion or two portions in the right-and-left direction between the lower portion of front edge of the ADF 2 and the corresponding upper surface of the housing 6. When the ADF 2 is at the closed position, therefore, the rear part of the support frame 10 is rotatably supported at an upper portion of rear edge of the housing 6 via the hinge mechanism 68 that will be described later, and the front part is supported by the magnet means at the upper part of front edge of the housing 6.

Figure 5:
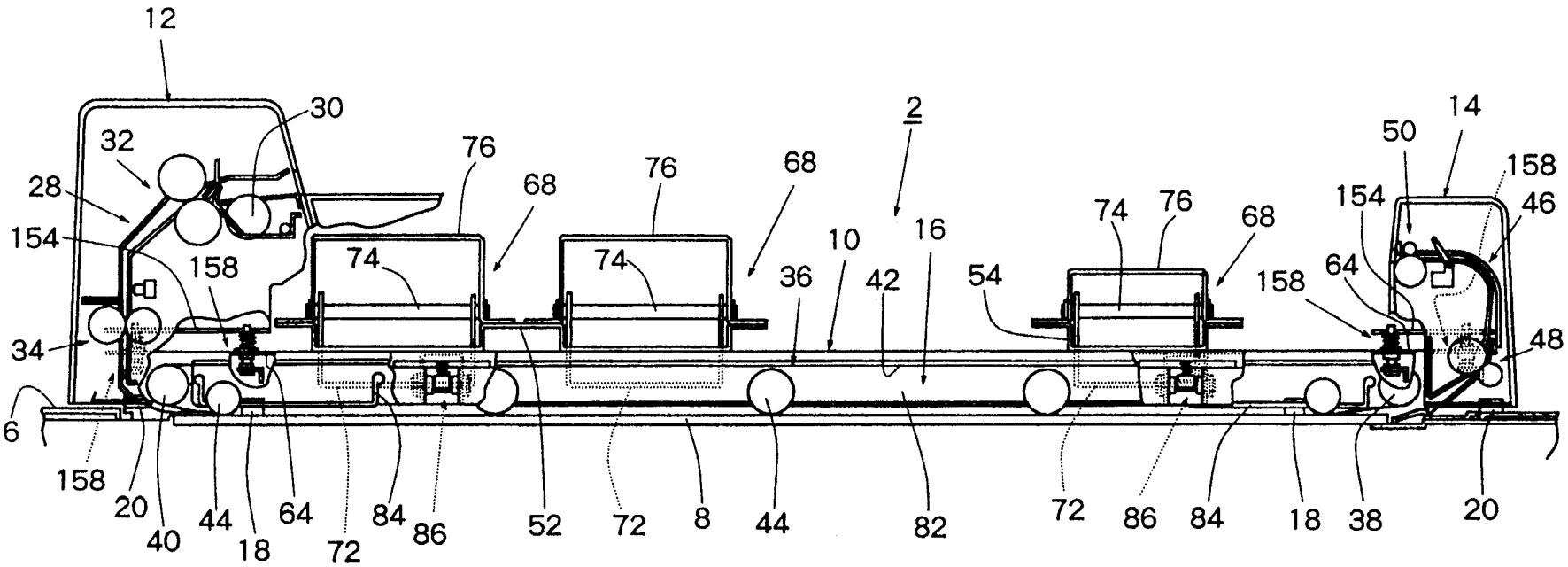
FIG. 5 is a schematic view which illustrates mainly the rear support portions of the units in the ADF shown in FIG. 3, in the right-and-left direction in cross section.

Referring to FIGS. 1, 2 and FIG. 5, the paper feeding unit 12 includes a guide plate means 28 which defines a document introduction passage, an introduction roller 30 provided in relation to the guide plate means 28, a pair of separation rollers 32, and a pair of conveyer rollers 34. The conveying unit 16 includes a conveying belt mechanism 36. Here, the conveying belt mechanism 36 includes a driven roller 38 and a follower roller 40 that are disposed, spaced at a distance, in the conveying direction (right-and-left direction in FIG. 2), an endless belt 42 wrapped round these rollers, and a plurality of pressing rollers 44. As will be described later, when the ADF 2 is brought to the closed position, the conveying belt mechanism 36 is opposed to the upper surface of the platen glass 8. Then, the action running portion, i.e., the lower running portion of the endless belt 42 is pressed onto the upper surface of the platen glass 8 by the action of the pressing rollers 44. When the endless belt 42 is rotated by a rotary drive source that is not shown, the document is conveyed from the left toward the right along the upper surface of the platen glass 8. The paper discharging unit 14 includes a guide plate means 46 that defines a document discharged passage and pairs of discharge rollers 48 and 50 that are provided in relation to the guide plate means 46.

The documents that are stacked on the document placing plate 22 are guided onto the guide plate means 28 by the rollers 30, 32 and 34 of the conveying unit 12, and are conveyed one piece by one piece toward the conveying belt mechanism 36 of the conveying unit 16. The documents are placed at a predetermined position on the upper surface of the platen glass 8 by the action of the conveying belt mechanism 36. Then, a predetermined step of copying is carried out in the electrostatic copying machine 4. After the copying step has been finished, the document is conveyed, by the conveying belt mechanism 36, toward the paper discharging unit 14. The document is guided onto the guide plate means 46 by the conveyer rollers 48 and 50 of the paper discharging unit 14, and is discharged onto the document receiving plate 24. The above-mentioned constitution and basic operations of the ADF 2 have been disclosed in the specification of Japanese Patent Application No. 276388/1991 (corresponding to U.S. patent application Ser. No. 07/953,969 and E.P. Appln. No. 92 116 768.0) filed by the present applicant on Sep. 30, 1991. In the present invention, the paper feeding unit 12, the paper discharging unit 14 and the conveying unit 16 may be constituted and may work in a manner known per se., and are not described any further.

Referring to FIGS. 3 to 6, the support frame 10 has front-rear frames 52 and 54 that extend back and forth, spaced at a distance, in the right-and-left direction, and a front frame 56 and a rear frame 58 that extend in parallel in the right-and-left direction, spaced at a distance, in the back-and-forth direction. The front-rear frame 52 is constituted by jointing two channel-like members in the right-and-left direction, and the front-rear frame 54 is constituted by a single channel-like member. The front frame 56 has a flat and horizontal base portion 60 and a folded portion 62 that upwardly extends at right angles from the front end thereof. The rear frame 58 has a flat and horizontal base portion 64 and a folded portion 66 that downwardly extends at right angles from the front end thereof. The upper surface of the horizontal base portion 60 of the front frame 56 is coupled to the lower surfaces at the front ends of channels of the front-rear frames 52 and 54, and the upper surface of the horizontal base portion 64 of the rear frame 58 is coupled to the lower surfaces at the rear ends of channels of the front-rear frames 52 and 54. The front-rear frames 52 and 54 are pivotably supported at their rear ends on the housing 6 via three substantially the same hinge mechanisms 68 that constitute a hinge means. That is, the front-rear frame 52 is supported via the two hinge mechanisms 68 and the front-rear frame 54 is supported via the one hinge mechanism 68. Each hinge mechanism 68 has a first bracket 70 fitted to the rear part of the housing 6, a second bracket 72 fitted onto the first bracket 70, and a third bracket 76 rotatably supported by the second bracket 72 via a shaft 74. The brackets 70, 72 and 76 are all constituted by a channel-like member. All the shafts 74 are positioned in alignment. Flanges formed at the lower ends on both sides of the third bracket 76 are fitted to the upper surfaces of the front-rear frames 52 and 54. Thus, the support frame 10 is supported on the housing 6 via hinge mechanisms 68 so as to be pivoted between the closed position (see FIG. 6) and the open position (see FIG. 7). Each hinge mechanism 68 is provided with a spring means (not shown) which holds the condition where the support frame 10 is maintained at the open position. The hinge mechanism 68 which includes the spring means is of widely known hinge mechanism and is not described any further.

Figure 6:
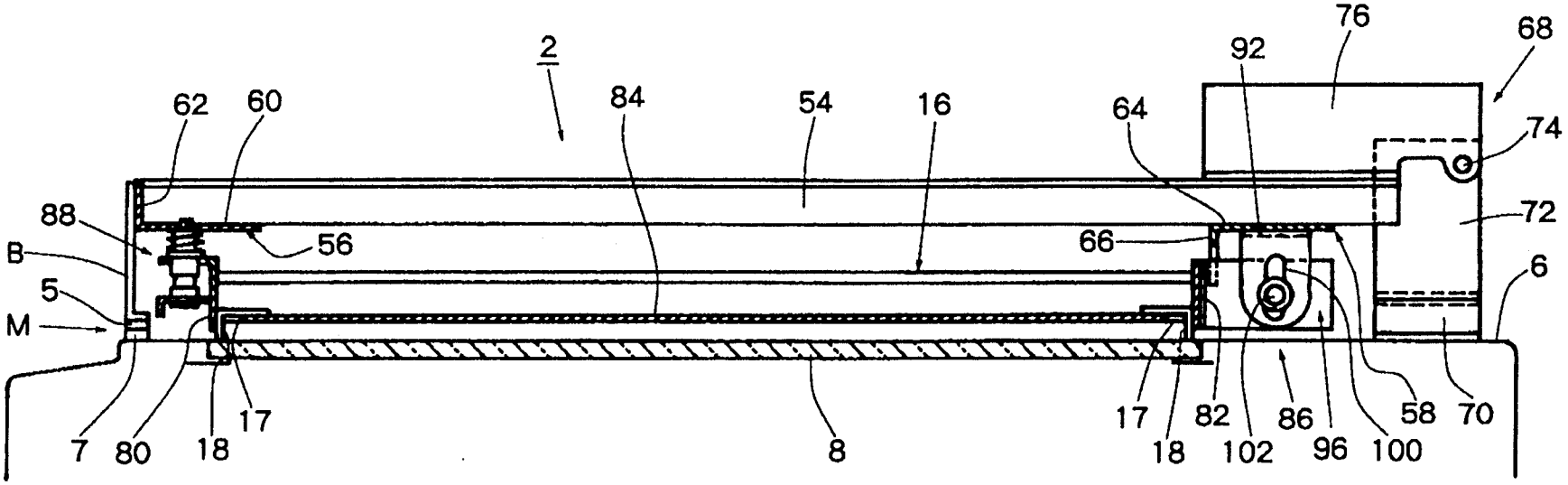
FIG. 6 is a sectional view along the arrow A—A in FIG. 4, and is a schematic view omitting some of the members.
Figure 7:
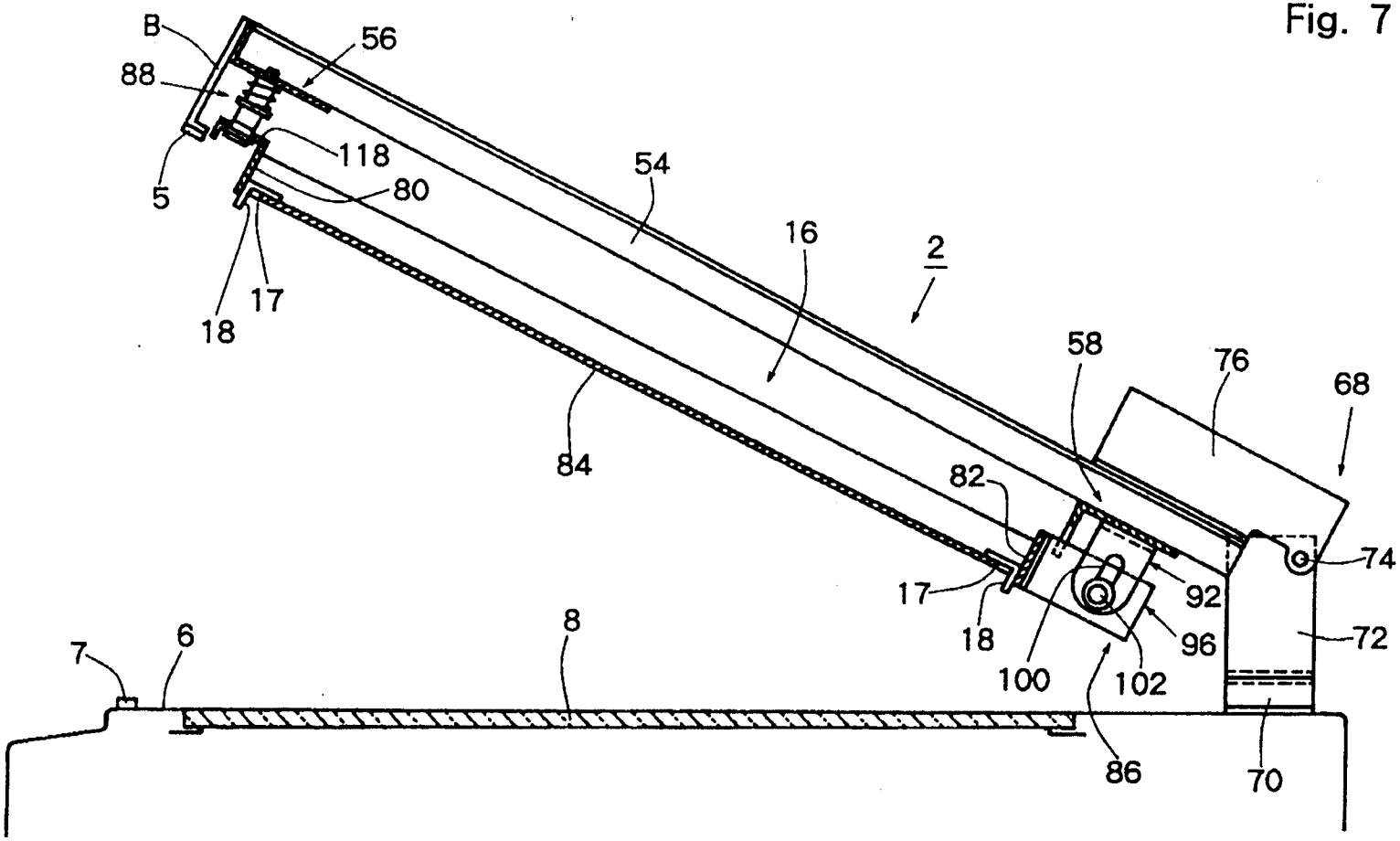
FIG. 7 is a drawing showing another operation condition of FIG. 6.

A magnet means (magnet catch) is provided between a central portion on the front side of the ADF and the upper surface of the housing 6. Specifically speaking, the magnet means M is constituted, as shown in FIGS. 6 and 7, by a magnet 5 attached to the lower end of a bracket B mounted on the folded portion 62 of the front frame 56 of the support frame 10 and a magnetic metal piece 7 attached to the corresponding upper surface of the housing 6. The magnet means M is provided at one central portion or two portions of front edge of the support frame 10 in the right-and-left direction. Therefore, the rear part of the support frame 10 is pivotably supported by the housing 6 via hinge mechanisms 68, and the central portion in the right-and-left direction of front edge of the support frame 10 is supported at its closed position by the housing 6 being attracted by the magnet means M.

Next, described below are the conveying unit 16 and its support mechanism. The conveying unit 16 is provided with a front side frame 80 and a rear side frame 82 which are disposed in the front-and-rear direction with a spaced distance, two support members 84 for coupling the frames 80 and 82 together, and the conveying belt mechanism 36 arranged between the frames 80 and 82, and is positioned, spaced at a distance, under the support frame 10. The driven roller 38, follower roller 40 and pressing rollers 44 of the conveying belt mechanism 36 are rotatably supported between the front side frame 80 and the rear side frame 82. The floating support means of the conveying unit 16 includes two substantially the same rear floating support mechanisms 86 that support at least two portions on the side of the rear side frame 82 of the conveying unit 16, and a front floating support mechanism 88 that supports at least one portion on the side of the front side frame 80. In this embodiment, the rear floating support mechanisms 86 and the front floating support mechanisms 88 are each provided in a number of two.

The rear floating support mechanism 86 will be described below with reference chiefly to FIG. 3, FIGS. 5 to 7, and particularly with reference to FIGS. 8 to 10. The rear floating support mechanism 86 includes a supporting bracket 92 that is fitted to the lower surface of the horizontal base portion 64 of rear frame 58 of the support frame 10 and has a pair of side support plates 90 that downwardly extend in the vertical direction at a distance spaced from each other, and a supported bracket 96 that is fitted to the rear side frame 82 of the conveying unit 16 and has a pair of vertical side plates 94 which rearwardly extend at a distance spaced from each other. The supporting bracket 92 is formed by folding a plate member into a U-shape, and its base portion is fitted to the horizontal base portion 64 in a manner that the open side thereof is downwardly directed. The supported bracket 96 is obtained by folding a plate member into a U-shape, and its flange portion (see FIG. 3) formed by being folded in the opposite directions toward the open side is fitted to the rear side frame 82. Substantially the same support holes 98 having a common horizontal axis are formed in the vertical side plats 94 of the supported bracket 96, and substantially the same oblong holes 100 extending in the vertical direction are formed in the side support plates 90 of the supporting bracket 92.

The side support plates 90 of the supporting bracket 92 and the vertical side plates 94 of the supported bracket 96 are so overlapped that the support holes 98 and the oblong holes 100 are in match with each other, and a coupling shaft 102 is rotatably supported passing through the support holes 98 of the supported bracket 96. The coupling shaft 102 is supported at its both ends by the support holes 98 and the oblong holes 100 via a pair of flanged collars 103 that penetrate through the support holes 98 and the oblong holes 100. The coupling shaft 102 is held via the collars 103 so as to move along the oblong holes 100, and an urging means is provided between the supporting bracket 92 and the coupling shaft 102 to urge the coupling shaft 102 toward the lower ends of the oblong holes 100. The supported bracket 96 is thus coupled to the supporting bracket 92. Specifically speaking, the urging means includes a coil spring 104 and a retainer member 106 which is disposed between the lower end of the coil spring 104 and the coupling shaft 102 and is pressed onto the coupling shaft 102. As shown in FIG. 10, the retainer member 106 includes a base portion 108 having a flat upper surface and a pair of receiving portions 110 that extend in parallel in the same direction from both ends of the base portion 108. At a central portion of the base portion 108 is formed an annular protuberance 112 to which the coil spring 104 will be fitted. In the ends of the receiving portions 110 is formed a semicircular recessed portion 114 that detachably comes into engagement with the outer peripheral surface of the coupling shaft 102. An annular protuberance 116 is further formed on the lower surface of base portion of the supporting bracket 92, such that the coil spring 104 will be fitted thereto. The retainer member 106 is so disposed as is brought into engagement with the outer peripheral surfaces between the collars 103 of the coupling shaft 102. Though not illustrated, it can be contrived to form a completely circular hole in the receiving portions 110 of the retainer member 106 instead of forming the semicircular recessed portion 114. The holes are positioned along the same axis, and the coupling shaft 102 is inserted therein. This embodiment has a merit in that the retainer member 106 does not escape from the coupling shaft 102 at the time of assembling.

Figure 8:
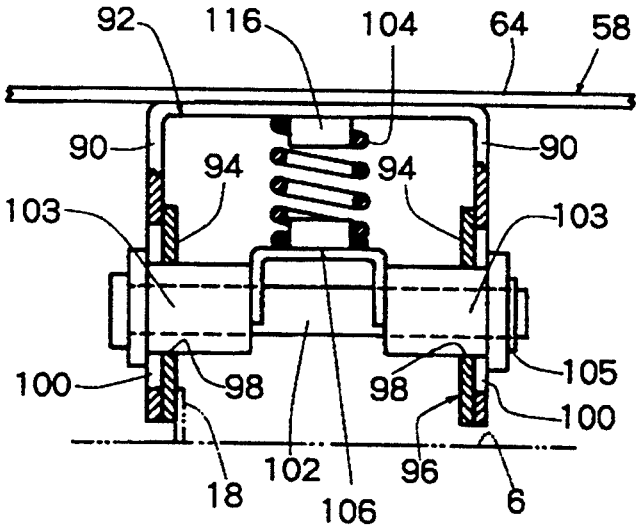
FIG. 8 is a schematic view showing, partly in cross section, an embodiment of the rear floating support mechanism of the conveying unit according to one aspect of the present invention.

Referring to FIGS. 6 and 8, when the support frame 10 is at the closed position, the rear portion of the support frame 10 is supported by the rear edge of the housing 6 at three places via hinge mechanisms 68, and its front portion is supported by the front edge of the housing 6 via the magnet means M thereby to define its closed position. The contact pieces 18 that will be described later and that are provided for the conveying unit 16 come in contact with the upper surface of the housing 6 to support the load of the conveying unit 16 and restrict their downward movement. Though not illustrated, the magnet means M is provided with a spring means on the side of the magnet 5 and is allowed to move by a predetermined amount in the up-and-down direction. The support frame 10 is brought to its closed position under the condition where the coil spring 104 is contracted. The upper and lower ends of oblong holes 100 of the support frame 10 are so located as to define a predetermined gap relative to the coupling shaft 102. As a result, even when the support frame 10 is deflected, the displacement is absorbed by the coil spring 104 and by the gap of oblong holes 100, permitting the posture of the conveying unit 16 to be normally maintained.

Figure 9:
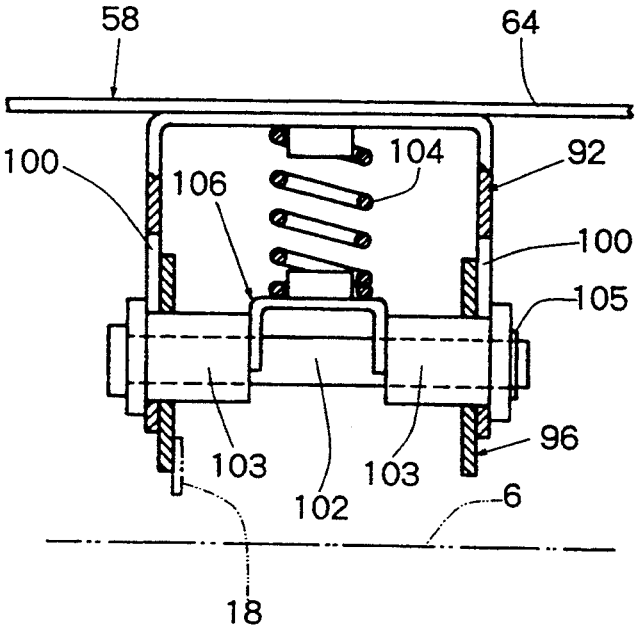
FIG. 9 is a drawing showing another operation condition of FIG. 8.

With reference to FIGS. 7 and 9, when the support frame 10 is upwardly opened by a predetermined angle from the closed position shown in FIG. 6 via the hinge mechanisms 68, the weight of the conveying unit 16 works and as a result, the coupling shaft 102 is pushed via collars 103, being urged by the coil spring 104, onto the lower ends of the oblong holes 100, whereby the rear side frame 82 is supported by the support frame 10. Even when the posture of the conveying unit 16 is tilted, therefore, much of the load is stably supported by the lower ends of the oblong holes 100 via the coupling shaft 102 and collars 103.

To disconnect the rear side frame 82 from the support frame 10, a known stop ring 105 (see FIG. 8) fitted to an end of the coupling shaft 102 is removed and then, the coupling shaft 102 is pulled away in the axial direction while leaving the collars 103. At this moment, the retainer member 106 and the coil spring 104 are removed. Next, the collars 103 are pulled away from the support holes 98 of the supported bracket 96 and from the oblong holes 100 of the supporting bracket 92. Thus, the supporting bracket 92 is disconnected from the supported bracket 96. That is, by simply removing the coupling shaft 102 and the collars 103 from the supporting bracket 92 and the supported bracket 96, the rear side frame 82 of the conveying unit 16 is very easily disconnected from the rear end of the support frame 10. Therefore, the jamming can be treated and the maintenance operation can be carried out very efficiently. And, they can be mounted easily, as a matter of course.

Next, described below is the front floating support mechanism 88 of the conveying unit 16 with reference chiefly to FIGS. 3, 4, 6 and 7, and particularly to FIGS. 11 to 13. Each of the front floating support mechanisms 88 which are substantially the same and are provided at two places includes a coupling protrusion 118 that is formed on the front side frame 80 of the conveying unit 16 to extend substantially horizontally, a collar 122 that is fitted in a hole 120 formed in the coupling protrusion 118 to move in the axial direction, and a support bolt 128 which is inserted in a through hole 124 of the collar 122 to move in the axial direction relative thereto, which is detachably screwed at its upper end into the horizontal base portion 60 of front frame 56 of the support frame 10 and which has a head portion 126 at its lower end. At a position where the front floating support mechanism 88 is mounted on the left side in FIG. 4, the lower surface of the front-rear frame 52 is intimately coupled to the upper surface of the horizontal base portion 60, and the support bolt 128 is further screwed into the front-rear frame 52. The collar 122 has an annular flange 130 formed at an upper end thereof having a diameter greater than that of a cylindrical portion that fits into the hole 120 of the coupling protrusion 118, and is prevented from moving downwards beyond the coupling protrusion 118. A spring means or, concretely, a coil spring 132 is disposed between the upper end (flange 130) of the collar 122 and the horizontal base portion 60 of the support frame 10 via the collar 122 and coupling protrusion 118, and always urges the front side frame 80 downwardly. An annular, position-restricting flange 134 is formed over the head portion 126 of the support bolt 128 while maintaining a gap in the axial direction. The position-restricting flange 134 has such an outer diameter that restricts the downward movement of the collar 122 on the support bolt 128 and that movably fits into the hole 120 of the coupling protrusion 118. The head portion 126 has such an outer diameter that movably fits into the hole 120 of the coupling protrusion 118.

A stop ring member 136 having a portion which is greater in the radial direction than the position-restricting flange 134 is detachably attached between the head portion 126 of the support bolt 128 and the position-restricting flange 134 without being allowed to move in the axial direction. The stop ring member 136 is made of a synthetic resin and has a predetermined thickness and resiliency, and further has an annular flat base portion 140 with a notch 138 of a predetermined gap in an end portion thereof and a protrusion 142 that downwardly extends in an L-shape from an end of the flat base portion 140 of the side opposite to the notch 138. In the central portion of the flat base portion 140 is formed an engaging hole 144 having an inner diameter that fits to the outer diameter of the support bolt 128 between the head portion 126 and the position-restricting flange 134. Since the stop ring member 136 has resiliency, the opposing ends of the notch 138 can be expanded by a predetermined amount in a direction to separate away from each other. With the notch 138 being expanded, the stop ring member 136 can be easily fitted from the external side in the radial direction to the portion of the support bolt 128 between the head portion 126 and the position-restricting flange 134.

Figure 11:
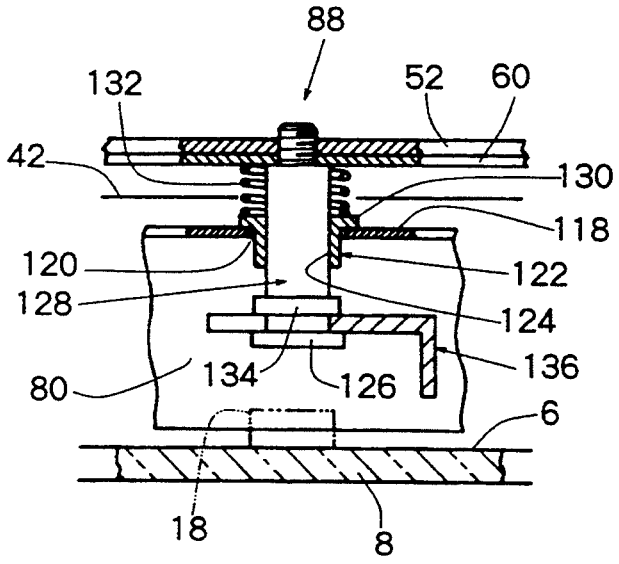
FIG. 11 is a drawing which schematically illustrates, partly in cross section, an embodiment of the front floating support mechanism of the conveying unit according to one aspect of the present invention.

Referring to FIGS. 6 and 11, when the support frame 10 is at the closed position, the rear part of the support frame 10 is supported by the rear edge portion of the housing 6 via the hinge mechanisms 68, and the front part thereof is supported by the front edge portion of the housing 6 via the magnet means M, so that the closed position thereof is defined. Contact pieces 18 provided for the conveying unit 16 come in contact with the upper surface of the housing 6 to support the load of the conveying unit 16 and to restrict the downward movement. As described earlier, the support frame 10 is restricted for its closed position by the hinge mechanisms 68 and the magnet means M with the coil spring 132 being contracted. The lower surface of the coupling protrusion 118 of the front side frame 80 is so positioned as to maintain a predetermined gap relative to the upper surface of the stop ring member 136. Therefore, even when the support frame 10 is deflected, the displacement is absorbed by the coil spring 132 and the gap, and the conveying unit 16 is permitted to maintain its normal posture.

Figure 12:
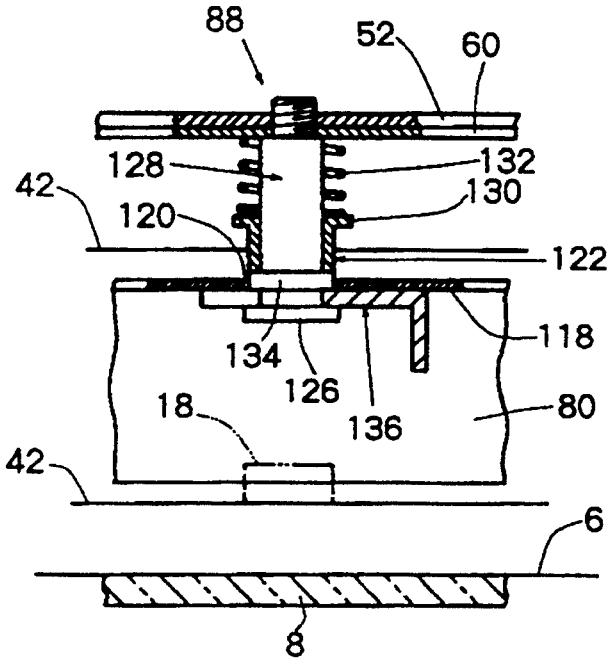
FIG. 12 is a drawing illustrating another operation condition of FIG. 11.
Figure 13:
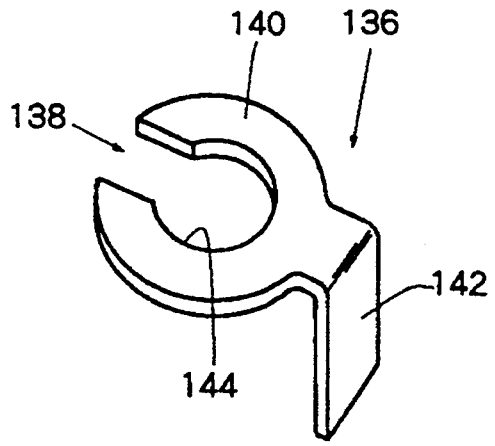
FIG. 13 is a perspective view which schematically illustrates a stop ring member shown in FIG. 11.

Referring to FIGS. 7 and 12, when the support frame 10 is upwardly opened by a predetermined angle from the closed position shown in FIG. 6 via the hinge mechanisms 68, the coil spring 132 extends due to the weight of the conveying unit 16. The coupling protrusion 118 downwardly moves together with the collar 122 along the support bolt 128. The lower end of the collar 122 comes in contact with the upper surface of the position-restricting flange 134, and is prevented from moving downwards. The coupling protrusion 118 further moves downwards beyonds the cylindrical portion of the collar 122, and its lower surface comes in contact with the upper surface of the stop ring member 136 while being fitted to the outer periphery of the position-restricting flange 134, and is thus prevented from moving downwards any more. Thus, the front side frame 80 is supported by the support frame 10.

To disconnect the front side frame 80 from the support frame 10, the stop ring member 136 is removed from the outer peripheral portion of the support bolt 128 between the head portion 126 and the position-restricting flange 134. This can be easily done by expanding the notch 138 of the stop ring member 136 and pulling it out in the radial direction. The head portion 126 of support bolt 128 and the position-restricting flange 134 have outer diameters that are smaller than the inner diameter of hole 120 of coupling protrusion 118 of the front side frame 80. Therefore, the support bolt 128 can be upwardly pulled out from the hole 120 of the coupling protrusion 118 by upwardly opening the support frame 10 via the hinge mechanisms 68 under the condition where the support bolt 128 is not removed from the support frame 10 (horizontal base portion 60 and front-rear frame 52 in FIGS. 11 and 12) but is maintained coupled thereto. That is, by simply removing the stop ring member 136 from the support bolt 128, the front frame 80 of the conveying unit 16 is disconnected from the front end of the support frame 10, enabling the jamming to be treated and the maintenance operation to be carried out very efficiently. Also, they can be mounted very easily.

Next, described below with reference to FIGS. 3 to 7 is the spacer means provided for the conveying unit 16. The support members 84 of the conveying unit 16 are constituted by metallic channel-like members, and their both ends in the back-and-forth direction are fastened to the front side frame 80 and to the rear side frame 82. Each support member 84 has a notch 17 formed at its both ends. Though not clearly illustrated, the notch 17 has a rectangular hole. The spacer means provided for the conveying unit 16 are constituted by the L-type contact pieces 18 which are of substantially the same shape and are fastened to the upper flat surfaces near the notches 17 of the support members 84. The contact piece 18 is formed by folding a rectangular plate member. The lower end of each contact piece 18 is so designed as to downwardly protrude through the notch 17. As will be obvious from FIG. 6, each contact piece 18 defines the lowermost portion of the conveying unit 16, comes into direct contact with the platen glass 8 at the closed position of the support frame 10 to support the load of the conveying unit 16, and maintains the normal posture of the conveying unit 16. The contact pieces 18 are provided in a number of two each on the side of the front side frame 80 and on the side of the rear side frame 82 of the conveying unit 16. As a result, the conveying unit 16 is stably maintained on the platen glass 8, and a predetermined gap is reliably maintained between the endless belt 42 and the platen glass 8.

Next, described below with reference chiefly to FIGS. 3 to 5 and FIGS. 14 and 15 is the floating support means which supports at least one of the paper feeding unit 12 and the paper discharging unit 14. At least one of the paper feeding unit 12 and the paper discharging unit 14, or both of them, in this embodiment, are provided with a front side plate 150 and a rear side plate 152 as is obvious from FIG. 3. The guide plate means 28, introduction roller 30, the pair of separation rollers 32 and the pair of conveying rollers 34 that are elements constituting the paper feeding unit 12 as described above with reference to FIG. 2, are provided between the front side plate 150 and the rear side plate 152. Furthermore, the guide plate means 46, the pairs of discharge rollers 48 and 50 which are elements constituting the paper discharging unit 14 are also provided between front side plate 150 and the rear side plate 152. Each of the front side plates 150 has a horizontal support portion 154 that horizontally extends forwards and a vertical portion 156 that downwardly extends from the front end of the horizontal support portion 154. Each of the rear side plates 152 is also, like the front side plates 150, provided with a horizontal support portion 154 (see FIG. 5) that horizontally extends rearwardly and a vertical portion 156 (not shown) that downwardly extends from the rear end of the horizontal support portion 154. The horizontal support portions 154 are located over the support frame 10 or, specifically, over the front frame 56 and the rear frame 58 of the support frame 10, spaced at a distance. The floating support means which supports the paper feeding unit 12 and the paper discharging unit 14, includes floating support mechanisms 158 that support at least one place, or two places in this embodiment, of the front side plate 150 and the rear side plate 152, respectively. The floating support mechanisms 158 are substantially the same and hence, the following description deals with only a floating support mechanism 158 of the front side plate 150 of the paper feeding unit 12. As will be easily understood from the following description, the floating support mechanism 158 is constituted substantially in the same manner as the floating support mechanism 88 of the conveying unit 16 described earlier, but is different with regard to its form of support. Therefore, the same portions as those of the floating support mechanism 88 are denoted by the same reference numerals, and the description is not repeated unless required.

The floating support mechanism 158 includes a collar 122 that is fitted, movably in the axial direction, in the hole 120 formed in the support frame 10 or, specifically, formed in the horizontal base portion 60 of the front frame 56, and a support bolt 128 that passes through the hole 124 of the collar 122 to move in the axial direction relative thereto, the support bolt 128 being detachably screwed at its upper end into the horizontal support portion 154 of the front side plate 150 and having a head portion 126 at the lower end thereof. The collar 122 has an annular flange 130 which prevents the downward movement beyond the horizontal base portion 60. Between the upper end of the collar 122 and the lower surface of the horizontal support portion 154 is disposed a spring means or, specifically, a coil spring 132 that upwardly urges the horizontal support portion 154 at all times. The stop ring member 136 is fitted between the head portion 126 of the support bolt 128 and the position-restricting flange 134.

Figure 4:
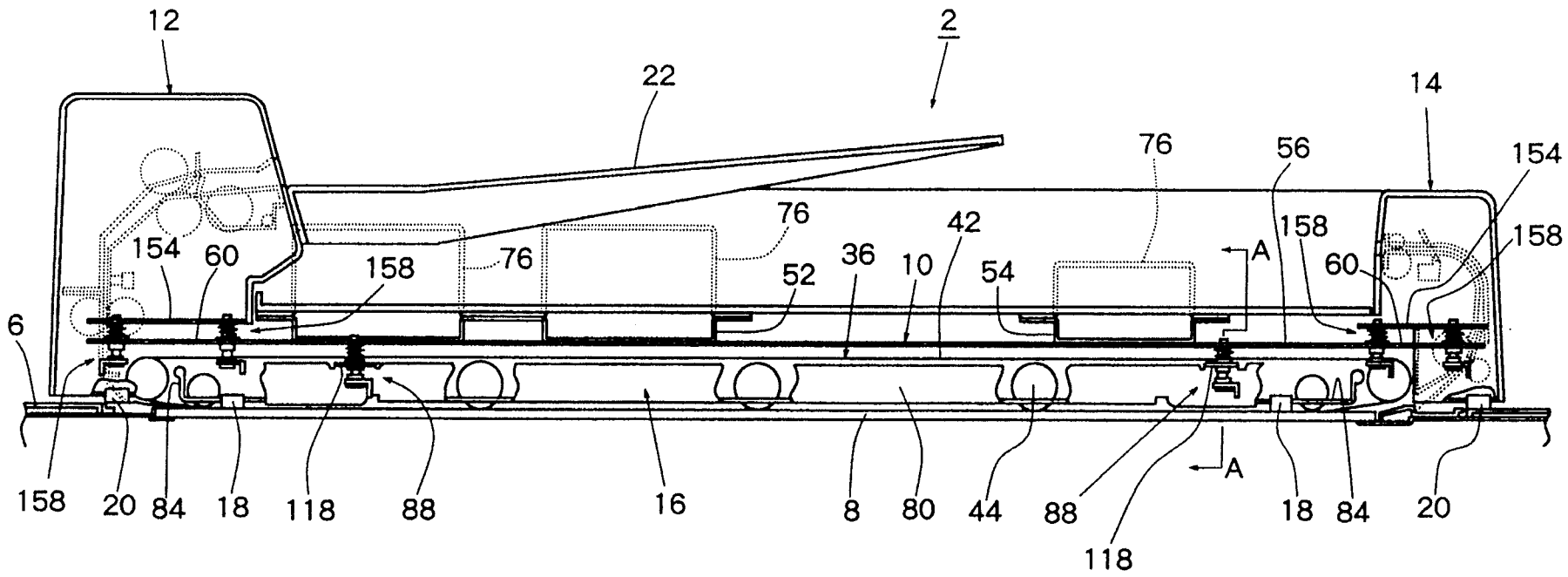
FIG. 4 is a schematic view which illustrates mainly the front support portions of the units in the ADF shown in FIG. 3, in the right-and-left direction in cross section.
Figure 14:
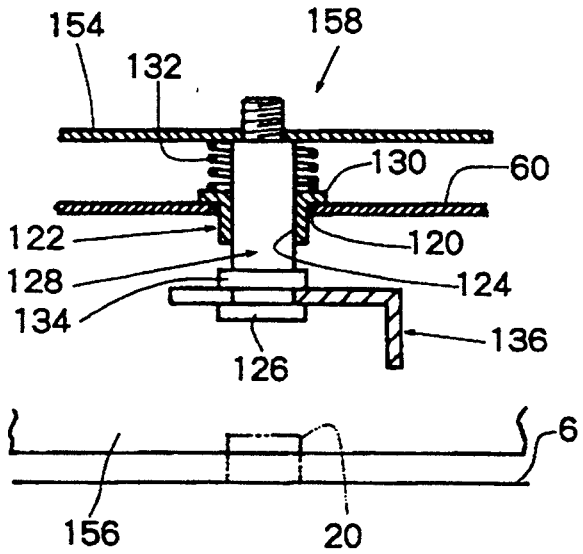
FIG. 14 is a drawing which schematically illustrates, partly in cross section, one embodiment of the floating support mechanism of at least either one of the paper feeding unit or the paper discharging unit according to one aspect of the present invention.
Figure 15:
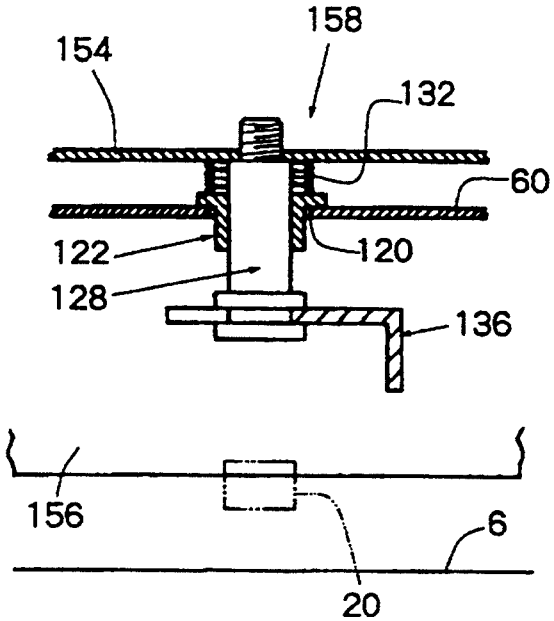
FIG. 15 is a drawing illustrating another operation condition of FIG. 14.

With reference to FIGS. 4, 6 and 14, when the support frame 10 is at the closed position, the rear part of the support frame 10 is supported by the rear edge of the housing 6 via the hinge mechanisms 68 as described earlier, and its front part is supported by the front edge portion of the housing 6 via the magnet means M to define the closed position. Contact pieces 20 that will be described later and that are provided in a number of two for each of the lower portions of the front side plate 150 and the rear side plate 152 of the paper conveying unit 12, come in contact with the upper surface of the housing 6 to support the load of the paper feeding unit 12, and restrict the downward movement. The lower surface of the horizontal base portion 60 of the support frame 10 is so located as to maintain a predetermined gap relative to the upper surface of the stop ring member 136. As a result, even when the support frame 10 is deflected, the displacement is absorbed by the gap, and the paper conveying unit 12 maintains its normal posture. Referring to FIGS. 4, 7 and 15, when the support frame 10 is upwardly opened by a predetermined angle from the closed position via the hinge mechanisms 68, the horizontal support portion 154 of the paper conveying unit 12 is supported on the horizontal base portion 60 of the support frame 10 via the coil spring 132. It will be easily understood that the above-mentioned action is carried out in substantially the same manner even in the paper discharging unit 14.

To disconnect the horizontal support portion 154 of the paper feeding unit 12 from the horizontal base portion 60 of the support frame 10, the stop ring member 136 is first removed from the outer peripheral portion of the support bolt 128 between the head portion 126 and the position-restricting flange 134. When the paper feeding unit 12 is lifted up under this state, the support bolt 128 is upwardly pulled out from the hole 120 of the horizontal base portion 60 while being coupled to the horizontal support portion 154. That is, by simply removing the stop ring member 136 from the support bolt 128, it is allowed to remove the paper feeding unit 12 from the support frame 10, enabling the jamming to be treated and the maintenance operation to be carried out very efficiently. Moreover, the paper feeding unit 12 can be mounted on the support frame 10 very easily. The above-mentioned action is carried out in substantially the same manner in the paper discharging unit 14.

Figure 3:
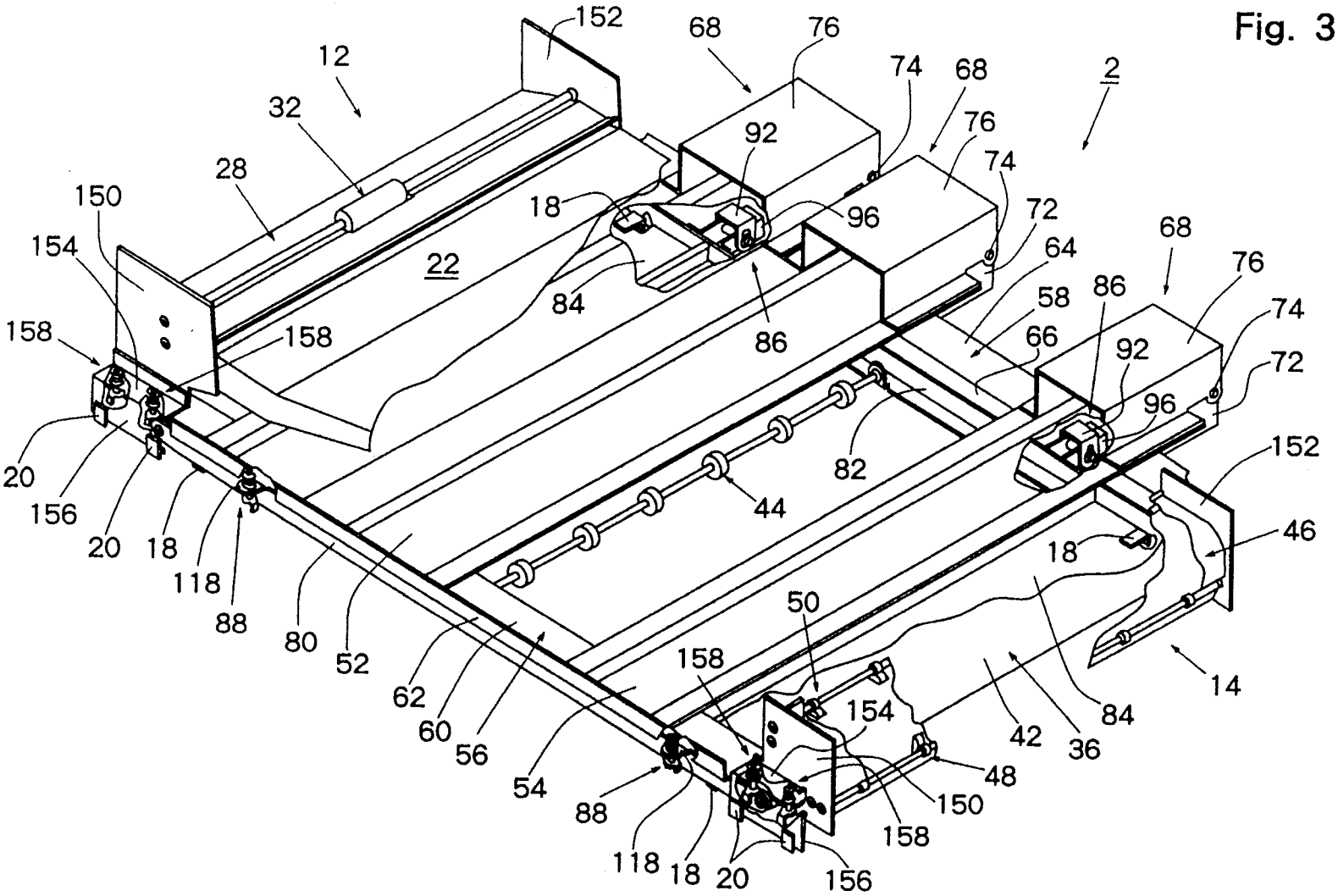
FIG. 3 is a perspective view which schematically illustrates chief portions of the ADF of FIG. 1, partly in a cut-away manner.

Referring to FIGS. 3 to 5, either the paper feeding unit or the paper discharging unit 14 or both of them in this embodiment are provided with spacer means that comes in contact with the housing 6 at the closed position. The spacer means is constituted by two contact pieces 20 which are so secured as to downwardly protrude from the lower portions of the vertical portions 156 of each of the front side plates 150 and rear side plates 152. Therefore, the contact pieces 20 are provided in a number of four for each of the units, i.e., in a number of two for each front and rear of the paper feeding unit 12 and the paper discharging unit 14. The contact pieces 20 define the lowermost portions of the paper feeding unit 12 and the paper discharging unit 14, and support the loads of the units 12 and 14 at the closed position of the support frame 10, so that they maintain their normal postures. The contact pieces 20 may be provided in a number of one for each front and rear of the units 12 and 14.

Next, described below is the action of the ADF 2. In the ADF 2, not only the conveying unit 16 but also the paper feeding unit 12 and/or the paper discharging unit 14 are supported by the support frame 10 via floating support mechanisms 158, and either the paper feeding unit 12 or the paper discharging unit 14 is provided with contact pieces 20 that come in contact with the housing 6 at the closed position of the support frame 10 or the ADF 2. At the closed position of the ADF 2, therefore, the load of either the paper feeding unit 12 or the paper discharging unit 14 is supported by the contact pieces 20, making it possible to reliably prevent the support frame 10 from being deflected and to maintain a predetermined proper posture with respect to the upper surface of the housing 6. Moreover, even when the support frame 10 is deflected to some extent and is downwardly displaced, such a displacement is absorbed well by the floating support mechanisms since either the paper feeding unit 12 or the paper discharging unit 14 is supported by the support frame 10 via the floating support mechanisms 158, and the units 12 and 14 are not affected in their postures. Either the paper feeding unit 12 or the paper discharging unit 14 is constituted as described above because of the reason that either one of the units is relatively lighter than the other unit, the ADF 2 has relatively short lengths in the back-and-forth direction and in the right-and-left direction and, hence, even when the other unit is directly supported by the support frame 10, it is considered that the support frame 10 of the side of the other unit is not substantially deflected. As a matter of course, the effects are guaranteed more reliably if both the paper feeding unit 12 and the paper discharging unit 14 are constituted as described above. Besides, since the conveying unit 16 is supported by the support frame 10 via the rear floating support mechanisms 86 and the front floating support mechanisms 88, it needs not be mentioned that its predetermined posture is properly maintained at all times with respect to the upper surface of the platen glass 8. According to the above-mentioned one aspect of the present invention, the support frame 10 is reliably prevented from being deflected, and the whole units including not only the conveying unit 16 but also the paper feeding unit 12 and the paper discharging unit 14 are always maintained in their predetermined proper postures at the closed position, making it possible to reliably prevent the papers from being fed or discharged in a tilted manner.

Figure 16:
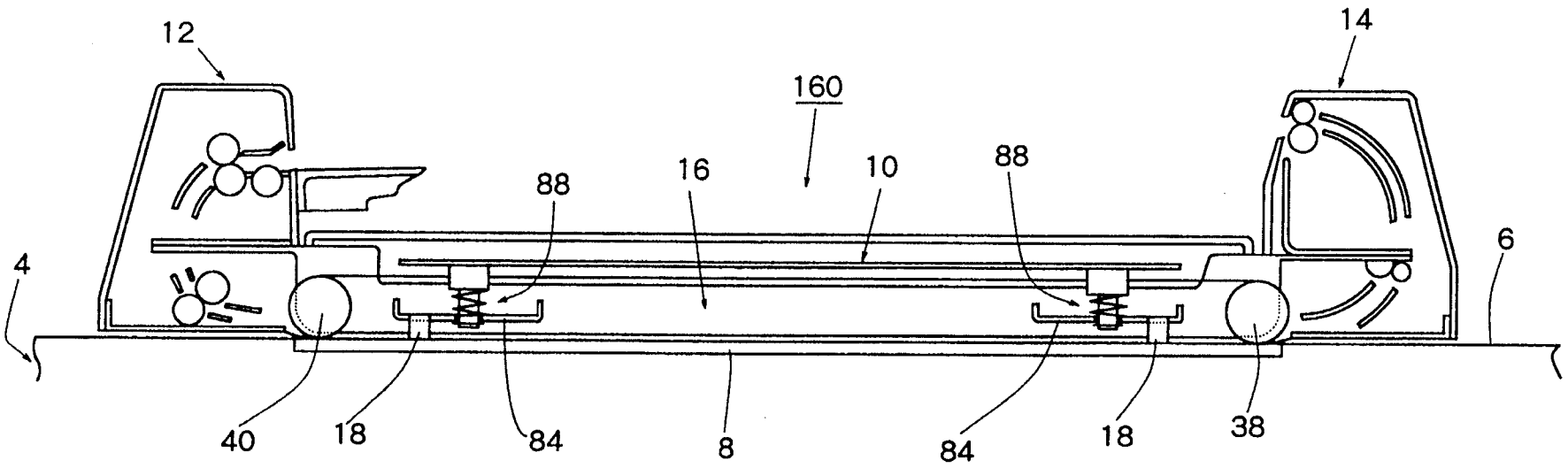
FIG. 16 is a drawing which schematically illustrates, in cross section, the ADF like FIG. 2, and conceptually shows another aspect of the present invention.
Figure 17:
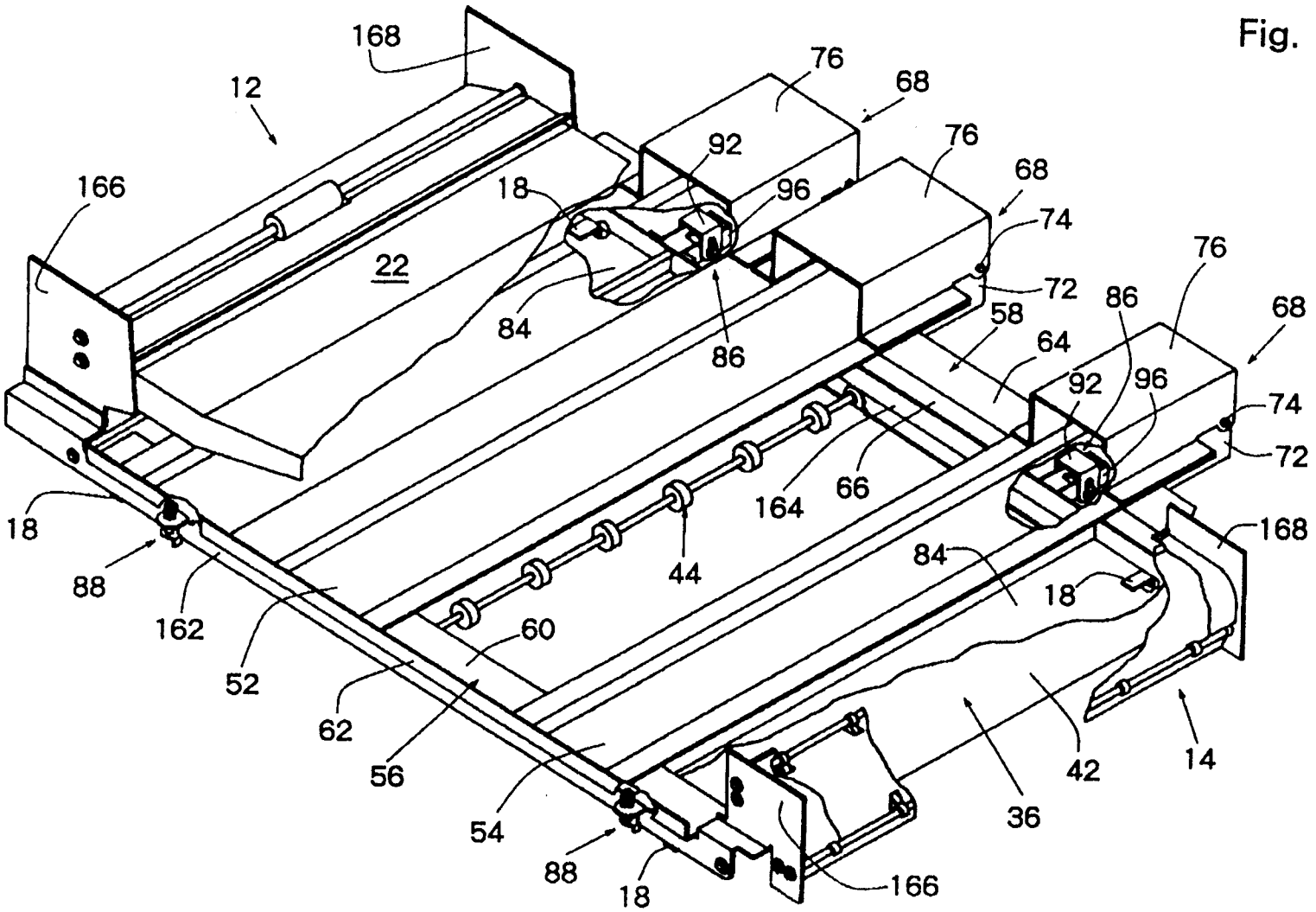
FIG. 17 is a perspective view which schematically illustrates, partly in a cut-away manner, chief portions of the ADF shown in FIG. 16.

Next, described below with reference to FIGS. 16 and 17 is an embodiment of an ADF 160 constituted according to another aspect of the present invention. In FIGS. 16 and 17, the same portions as those of FIGS. 1 to 15 are denoted by the same reference numerals. The ADF 160 shown in FIGS. 16 and 17 is different from the ADF 2 shown in FIGS. 1 to 15 with respect to a support means by which the paper feeding unit 12 and the paper discharging unit 14 are supported relative to the support frame 10, and further with respect to a spacer means related thereto. The constitution in other respects is substantially the same as that of the aforementioned ADF 2, and the same portions are denoted by the same reference numerals, and different constitutions only will be described.

In the ADF 160 shown in FIGS. 16 and 17, the paper feeding unit 12 and the paper discharging unit 14 are firmly supported on a front side frame 162 and on a rear side frame 164 of the conveying unit 16. That is, the paper feeding unit 12 and the paper discharging unit 14 are each provided with a front side plate 166 and a rear side plate 168. The front side plates 166 are integrally coupled to both ends in the lengthwise direction of the front side frame 162 of the conveying unit 16, and the rear side plates 168 are integrally coupled to both ends in the lengthwise direction of the rear side frame 164 of the conveying unit 16. The left portion of the front side frame 162 extends up to the side position of the paper feeding unit 12, and at this side position, is fastened to the front side plate 166. The right side of the front side frame 162 extends up to a side position of the paper discharging unit 14 and has, at this side position, the front side plate 166 formed integrally therewith. Though not illustrated, the rear side frame 164 and the rear side plate 168 are constituted in substantially the same manner as those described above. The front frame 56 and the rear frame 58 of the support frame 10 need not support the paper feeding unit 12 and the paper discharging unit 14, and their overall lengths are somewhat shorter than those of the ADF 2. No spacer means is provided under the front side plate 166 and under the rear side plate 168. As will be obvious from the foregoing description, the paper feeding unit 12 and the paper discharging unit 14 are supported together with the conveying unit 16 on the support frame 10 via the front side frame 162 and the rear side frame 164 by the rear floating support mechanisms 86 and the front floating support mechanisms 88. The spacer means is constituted by a total of four contact pieces 18 provided for each of the support members 84 of the conveying unit 16. The constitution in other respects is the same as that of the aforementioned ADF 2, and is not described here again.

Described below is the action of the ADF 160. In the ADF 160, the conveying unit 16 is supported on the support frame 10 by the rear floating support mechanisms 86 and the front floating support mechanisms 88, and is provided with contact pieces 18 that come in contact with the platen glass 8 at the closed position of the ADF 160. The conveying unit 16 is provided with the front side frame 162 and the rear side frame 164 that are disposed at a distance in the back-and-forth direction, support members 84 that couple the above frames, and the conveying belt mechanism 16 arranged between the above frames. The paper feeding unit 12 and the paper discharging unit 14 are supported on the front side frame 162 and on the rear side frame 164 of the conveying unit 16. That is, the paper feeding unit 12 and the paper discharging unit 14 are supported together with the conveying unit 16 on the support frame 10 via the front side frame 162 and the rear side frame 164 by the floating support mechanisms 86 and 88. At the closed position of the ADF 160, therefore, the loads of the paper feeding unit 12 and the paper discharging unit 14 are supported together with that of the conveying unit 16 by the contact pieces 18, making it possible to reliably prevent the support frame 10 from being deflected and to maintain predetermined proper postures with respect to the upper surface of the housing 6. Moreover, even when the support frame 10 is deflected to some extent and is downwardly displaced, such a displacement is absorbed well by the floating support mechanisms 86 and 88 since the paper feeding unit 12 and the paper discharging unit 14 are supported on the support frame 10 by such floating support mechanisms, and the units are not affected in the postures. Besides, since the conveying unit 16 is supported by the support frame 10 via the floating support mechanisms 86 and 88, it needs not mention that their predetermined postures are properly maintained at all times at the closed position with respect to the upper surface of the platen glass 8. According to the above-mentioned second aspect of the present invention, the support frame 10 is reliably prevented from being deflected, and the whole units including not only the conveying unit 16 but also the paper feeding unit 12 and the paper discharging unit 14 are always maintained in their predetermined proper postures at the closed position, making it possible to reliably prevent the papers from being fed or discharged in a titled manner. In the ADF 160, furthermore, the paper feeding unit 12 and the paper discharging unit 14 are supported together with the conveying unit 16 by the support frame 10 by the floating support mechanisms 86 and 88 of the conveying unit 16. Therefore, the paper feeding unit 12 and the paper discharging unit 14 do not require any additional floating support means. Accordingly, the aforementioned effects can be accomplished very easily and at a reduced cost.

Figure 18:
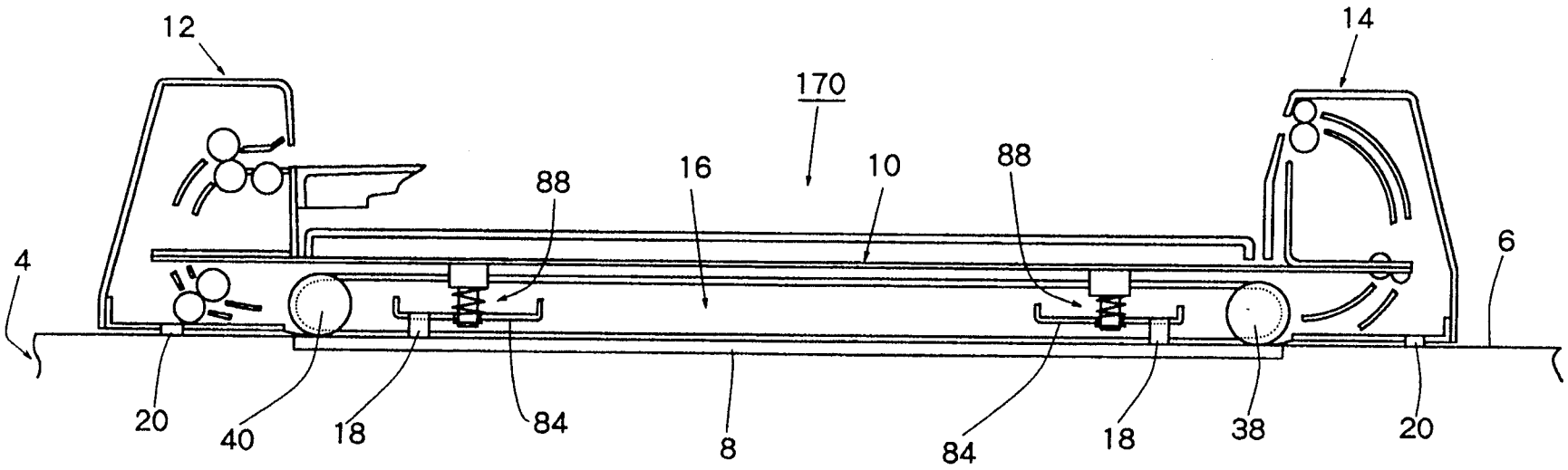
FIG. 18 is a drawing which schematically illustrates, in cross section, the ADF like 2, and conceptually shows a further aspect of the present invention.
Figure 19:
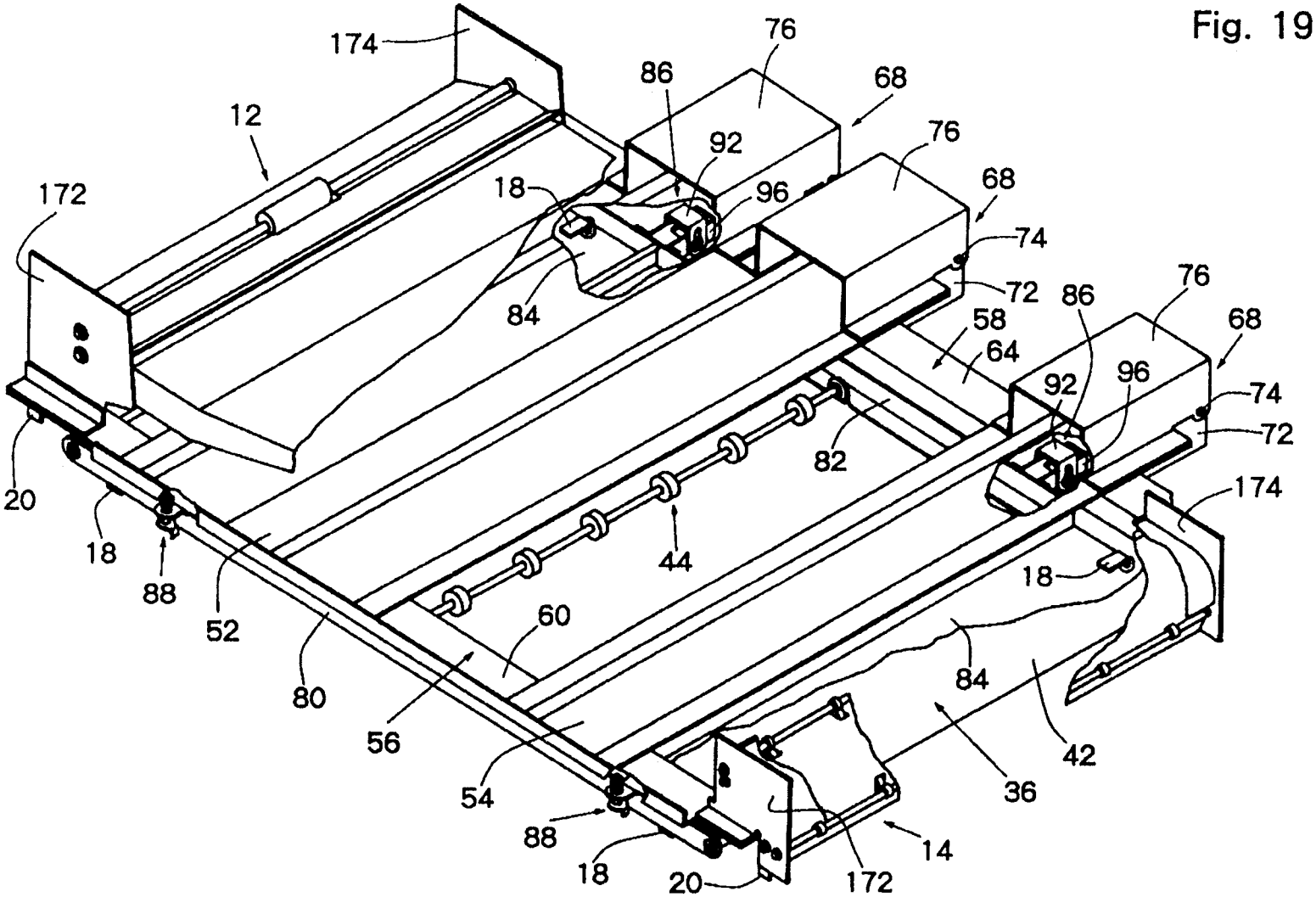
FIG. 19 is a perspective view which schematically illustrates, partly in a cut-away manner, chief portions of the ADF shown in FIG. 18.

Next, an embodiment of an ADF 170 constituted according to a further aspect of the present invention will be described with reference to FIGS. 18 and 19, wherein the same portions as those of FIGS. 1 to 15 are denoted by the same reference numerals. The ADF 170 shown in FIGS. 18 and 19 is different from the ADF 2 shown in FIGS. 1 to 15 with respect to a support means by which the paper feeding unit 12 and the paper discharging unit 14 are supported relative to the support frame 10, and further with respect to a spacer means related thereto. The constitution in other respects is substantially the same as that of the ADF 2, and the same portions are denoted by the same reference numerals, and different portions only will be described.

In the ADF 170, the paper feeding unit 12 is firmly supported on one side of the support frame 10 (left in the drawing). The paper discharging unit 14 is firmly supported on the other side of the support frame 10 (right in the drawing). That is, the paper feeding unit 12 and the paper discharging unit 14 are each provided with a front side plate 172 and a rear side plate 174. The left side of the front frame 56 of the support frame 10 extends up to the lower position of the front side plate 172 of the paper feeding unit 12 and its right side extends up to the lower position of the front side plate 172 of the paper discharging unit 14. The front side plates 172 are secured to the horizontal base portion 60 of the front frame 56. Similarly, the left side of the rear frame 58 of the support frame 10 extends up to the lower position of the rear side plate 174 of the paper feeding unit 12 and its right side extends up to the lower position of the rear side plate 174 of the paper discharging unit 14. The rear side plates 174 are secured to the horizontal base portion 64 of the rear frame 58. At least one of the paper feeding unit 12 and the paper discharging unit 14, or both of them in this embodiment, are provided with spacer means at the lower portions on the side (front side) opposite to the hinge mechanisms 68, the spacer means coming in contact with the housing 6 at the closed position of the support frame 10. The spacer means is constituted by a contact piece 20 that is so secured as to downwardly protrude from the lower portion of each of the front side plates 172. The contact piece 20 on the side of the paper feeding unit 12, in this embodiment, is so secured as to downwardly protrude from the lower portion of the front frame 56 of the support frame 10 located under the front side plate 172. The constitution in other respects is the same as the aforementioned ADF 2, and is not described here again.

The action of the ADF 170 will now be described. In the ADF 170, the conveying unit 16 is supported on the support frame 10 by the floating support mechanisms 86 and 88, and the paper feeding unit 12 and the paper discharging unit 14 are firmly supported on the support frame 10. Then, at least one of the paper feeding unit 12 and the paper discharging unit 14 is provided with a contact piece 20 at a lower portion of the side opposite to the hinge mechanism 68, the contact piece 20 coming in contact with the housing 6 at the closed position of the ADF 170. This position where the contact piece 20 is provided is most effective in preventing the support frame 10 from being deflected. That is, as described earlier, the central portion of the front edge of the support frame 10 in the right-and-left direction is supported on the housing 6 by the magnet catch M, but both sides are not supported, leaving unstable factor from the standpoint of supporting the load. Moreover, when the paper feeding unit 12 and the paper discharging unit 14 are heavy, or when their weights are out of balance to a great degree, the moment of imbalance in the right-and-left direction acts on the front edge of the support frame 10 with the magnet catch M as a fulcrum, and the support frame 10 is easily deflected. In the ADF 170, therefore, the contact pieces 20 are provided for an area on which the greatest moment will act with respect to the support frame 10. As a result, the load of either the paper feeding unit 12 or the paper discharging unit 14 is partly supported by the contact piece 20 at the closed position of the ADF 170, and the support frame 10 is reliably prevented from being deflected, and predetermined proper postures are maintained with respect to the upper surface of the housing 6. At least one of the paper feeding unit 12 and the paper discharging unit 14 is constituted as described above because of the reason that the other unit is relatively light in weight, the ADF 170 has relatively short lengths in the back-and-forth direction and in the right-and-left direction and, hence, even when the load of the above other unit is not supported via the contact piece 20, it is considered that the support frame 10 of the side of the above other unit is not substantially deflected. As a matter of course, the effects are guaranteed more reliably if both the paper feeding unit 12 and the paper discharging unit 14 are constituted as described above. Besides, since the conveying unit 16 is supported on the support frame 10 by the floating support mechanisms 86 and 88, it needs not mention that their predetermined postures are properly maintained at all times with respect to the upper surface of the platen glass 8. According to the above-mentioned ADF 170, the support frame 10 is reliably prevented from being deflected, and the whole units including not only the conveying unit 16 but also the paper feeding unit 12 and the paper discharging unit 14 are always maintained in their predetermined proper postures at the closed position, making it possible to reliably prevent the papers from being fed or discharged in a tilted manner. In the ADF 170, furthermore, the aforementioned effects are accomplished by simply providing the contact pieces 20 at lower positions that are most effective in reliably preventing the support frame 10 from being deflected. Thus, the invention can be very easily put into practice and at a reduced cost without substantially changing the fundamental constitution of the conventional ADF.

Though the invention was described above in detail by way of embodiments, it should be noted that the invention is in no way limited to the above embodiments only but can be changed or modified in a variety of other ways without departing from the scope of the invention.

Figure 10:
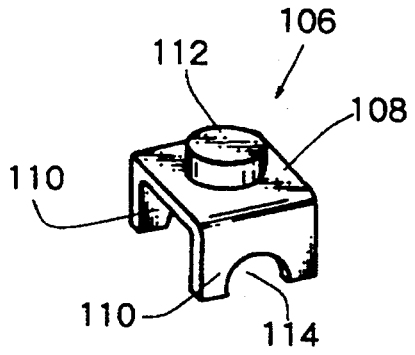
FIG. 10 is a perspective view which schematically illustrates a retainer member shown in FIG. 8.
Figure 20:
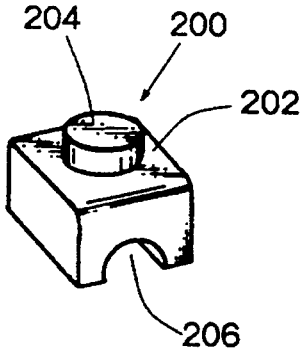
FIG. 20 is a perspective view which schematically illustrates a modified retainer member.
Figure 21:
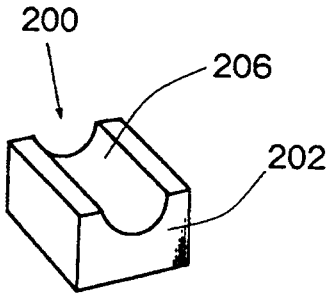
FIG. 21 is a perspective view of FIG. 20 seen from the direction of back surface thereof.

For instance, a retainer member 200 shown in FIGS. 20 and 21 is a modification from the retainer 106 shown in FIG. 10, and includes a base portion 202 of a substantially parallelepiped shape having a flat upper surface. At the central portion of the base portion 200 is formed an annular protuberance 204 to which the coil spring 104 will be fitted. A semicircular recessed portion 206 is formed in the surface of the base portion 200 on the side opposite to the annular protuberance 204, and extends from one end through up to the other end. The recessed portion 206 is so formed as to come into detachable engagement with the outer peripheral surface of the coupling shaft 102. The retainer member 200 is so disposed as to come into engagement with the outer peripheral surface between the collars 103 of the coupling shaft 102. The retainer member 200 engages with the coupling shaft 102 more stably and exhibits a larger strength in the axial direction than the retainer member 106.

Figure 22:
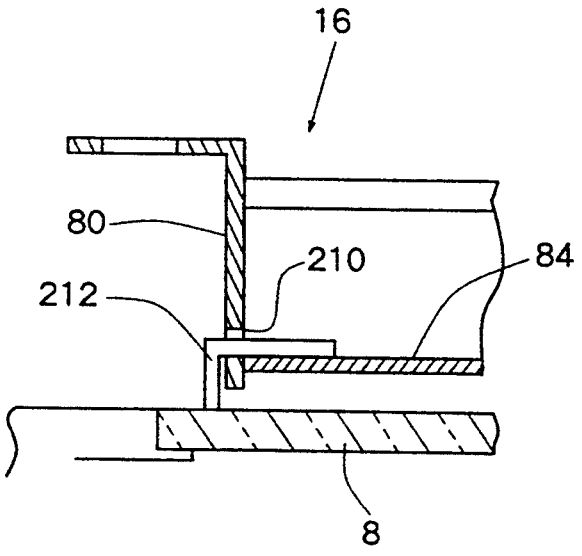
FIG. 22 is a sectional view showing a portion of a modified contact piece.

Described below are modified examples of the contact piece 18 (see FIGS. 6 and 7) which is a spacer means provided for the conveying unit 16. FIG. 22 illustrates a first modified example in which a notch 210 is formed at a portion of the front side frame 80 to which an end of the support member 84 will come in contact and will be secured. Though not clearly illustrated, the notch 210 is constituted by an oblong rectangular hole that runs along the upper edge of the support member 84. A contact piece 212 of an L-shape is secured to the flat upper surface near the notch 210 of the support member 84. The contact piece 212 is formed by folding a rectangular plate member. The folded end of the contact piece 212 protrudes toward the outer side of the support member 84 through the notch 210, and its lower end protrudes toward the lower side of the support member 84. though not illustrated, other contact piece 212 is similarly provided for a portion of the rear side frame 82 to where the other end of the support member 84 will come in contact and will be secured. In the foregoing was described a modified example of the contact piece which is the spacer means provided for the conveying unit 16.

Figure 23:
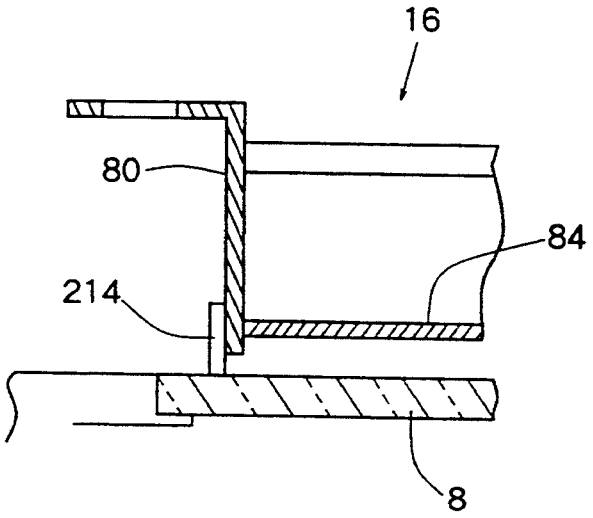
FIG. 23 is a sectional view showing a portion of another modified contact piece.

FIG. 23 illustrates another modified example of the contact piece in which a contact piece 214 is fitted to the outside of a portion of the front side frame 80 to where an end of the support member 84 will come in contact and will be secured. Though not clearly illustrated, the contact piece 214 is constituted by a rectangular plate member and its lower end protrudes toward the lower side of the support member 84. Though not illustrated, the other contact piece 214 is similarly provided on the outside of the portion of the rear side frame 82 to where the other end of the support member 84 will come in contact and will be secured. In the foregoing was described another embodified example of the contact piece which is the spacer means provided for the conveying unit 16. Like the contact pieces 18 mentioned earlier, the contact pieces 212 and 214 define the lowermost portions of the conveying unit 16, come into direct contact with the platen glass 8 at the closed position of the support frame 10 to support the load of the conveying unit 16, such that the posture of the conveying unit 16 is properly maintained.

The following effects are exhibited by the invention described above by way of embodiments.

(1) The support frame is reliably prevented from being deflected, making it possible to maintain the whole units including not only the conveying unit but also the paper feeding unit and the paper discharging unit in their predetermined proper postures at all times at the closed position of the ADF. Accordingly, the papers are prevented from being fed or discharged in a tilted manner, and the image can be transferred to a proper position of the copying paper at all times. Moreover, jamming takes place less and the ADF as a whole can have an extended life.

(2) In one aspect of the present invention, not only the conveying unit but also at least one of the paper feeding unit and the paper discharging unit are supported by the support frame via floating support means, and either the paper feeding unit or the paper discharging unit is provided with spacer means that comes in contact with the housing at the closed position of the support frame or the ADF. As a result, the support frame is prevented from being deflected and is efficiently maintained in its predetermined posture.

(3) According to another aspect of the present invention, the paper feeding unit and the paper discharging unit are supported together with the conveying unit by the support frame by the floating support means of the conveying unit. Therefore, no additional floating support means needs be provided for the paper feeding unit and the paper discharging unit, and the above-mentioned effects can be accomplished very easily and at a reduced cost.

(4) According to a further aspect of the present invention, the conveying unit is supported by the support frame via floating support means, and the paper feeding unit and the paper discharging unit are firmly held on the support frame. And, the spacer means is provided at a lower portion of either the paper feeding unit or the paper discharging unit on the side opposite to the hinge means, the spacer means coming in contact with the housing at the closed position of the support frame or the ADF. That is, according to this further aspect of the present invention, the aforementioned effects are accomplished by simply providing spacer means at a lower position which is most effective in reliably preventing the support frame from being deflected. Accordingly, the invention can be put into practice very easily and at a reduced cost without substantially changing the fundamental constitution of the conventional ADF.

(5) The front floating support mechanism of the conveying unit is so constituted that the conveying unit can be disconnected from the support frame by simply removing the stop ring member from the support bolt, enabling the jamming to be treated or the maintenance operation to be carried out very easily and efficiently. The conveying unit can also be coupled to the support frame very easily.

(6) The floating support mechanism (one aspect of the present invention) of at least one of the paper feeding unit and the paper discharging unit is also constituted in substantially the same manner as the front floating support mechanism of the conveying unit, allowing the above either one unit to be disconnected from the support frame by simply removing the stop ring member from the support bolt. As a result, the jamming can be treated or the maintenance operation can be carried out very easily and efficiently. The above either one unit can be coupled to the support frame very easily.

(7) The rear floating support mechanism of the conveying unit permits the conveying unit to be substantially disconnected from the support frame by simply removing the coupling shaft from the oblong holes, enabling the jamming to be treated and the maintenance operation to be carried out very easily and efficiently. The conveying unit can be coupled to the support frame very easily.

What we claim is:

1. An automatic document feeder comprising a support frame that is so supported via a hinge means as to be pivoted between a closed position and an open position with respect to a platen glass provided on a housing, a paper feeding unit that is firmly supported at one end of said support frame, a paper discharging unit that is firmly supported at the other end of said support frame, and a conveying unit that is supported between said units of said support frame via a floating support means, said conveying unit being provided with a spacer means that comes in contact with said platen glass at the closed position, the improvement wherein at least one of said paper feeding unit and said paper discharging unit is provided with a spacer means at a lower portion thereof on the side opposite to said hinge means, said spacer means coming in contact with said housing at the closed position.

2. An automatic document feeder according to claim 1, wherein:

said conveying unit is provided with a front side frame and a rear side frame arranged, spaced at a distance, in the back-and-forth direction, a support member that couples said frames together, and a conveying belt mechanism arranged between said frames, and is positioned under said support frame, spaced at a distance;

said floating support means of said conveying unit includes two substantially the same rear floating support mechanisms that support at least two places of the side of said rear side frame of said conveying unit, as well as a front floating support mechanism that supports at least one place of said front said frame;

each of said rear floating support mechanisms includes a coupling shaft provided in said conveying unit on the side of said rear side frame and a pair of oblong holes that are provided on the side of said support frames and that extend in the vertical direction, said coupling shaft is fitted into said oblong holes so as to move therealong, and an urging means is provided between said support frame and said coupling shaft to urge said coupling shaft toward the lower ends of said oblong holes, so that said rear side frame is coupled to said support frame;

when said support frame is at said closed position, the upper end and the lower end of said oblong holes of said support frame are so positioned as to maintain a predetermined gap relative to said coupling shaft; and when said support frame is upwardly opened by a predetermined angle from the closed position via said hinge means, said coupling shaft is pressed to the lower ends of the oblong holes which being urged by said urging means, and said rear side frame is supported by said support frame.

3. An automatic document feeder according to claim 1, wherein:

said conveying unit is provided with a front side frame and a rear side frame arranged, spaced at a distance, in the back-and-forth direction, a support member that couples said frames together, and a conveying belt mechanism arranged between said frames, and is positioned under said support frame spaced at a distance;

said floating support means of said conveying unit includes two substantially the same rear floating support mechanisms that support at least two places of said rear side frame of said conveying unit, as well as a front floating support mechanism that supports at least one place of said front side frame;

each of said rear floating support mechanisms includes a supporting bracket having side support plates that are secured to said support frame and that downwardly extend in the vertical direction at a distance spaced from each other, and supported brackets having vertical side plates that are secured to said rear side frame of said conveying unit and that rearwardly extend at a distance spaced from each other;

said vertical side plates of said supported bracket have support holes of substantially the same shape having a common horizontal axis, and said side support plates of said supporting bracket have oblong holes of substantially the same shape that extend in the vertical direction;

said side support plates of said supporting bracket and said vertical side plates of said supported bracket are so superposed that said support holes and said oblong holes are in alignment with each other, the coupling shaft is rotatably supported by the support holes of said supported bracket and is fitted in and allowed to move along said oblong holes, and an urging means is provided between said support bracket and said coupling shaft to urge said coupling shaft toward the lower ends of said oblong holes, such that said supported bracket is coupled to said supporting bracket;

when said support frame is at the closed position, the upper ends and the lower ends of said oblong holes of said side support frame are so positioned as to maintain a predetermined gap relative to said coupling shaft; and when said support frame is upwardly opened by a predetermined angle from the closed position via said hinge means, said coupling shaft is pressed to the lower ends of said oblong holes while being urged by said urging means, so that said rear side frame is supported by said support frame.

4. An automatic document feeder according to claim 3, wherein:

said urging means includes a coil spring and a retainer member that is disposed between the lower end of said coil spring and said coupling shaft, said retainer member being pressed onto said coupling shaft;

said retainer member includes a base portion and a pair of receiving portions that extend in parallel in the same direction from both ends of said base porion; and on the central portion of said base portion is formed an annular protuberance to which said coil spring will be fitted, and in the ends of said receiving portions is formed a semi-circular recessed portion that detachably comes into engagement with the outer peripheral surface of said coupling shaft.

5. An automatic document feeder according to claim 4, wherein said coupling shaft is supported at its both ends by a pair of collars that penetrate through said support holes and said oblong holes, and said retainer member is so disposed as to come into engagement with the outer peripheral surface between said collars of said coupling shaft.

6. An automatic document feeder according to claim 1, wherein:

said conveying unit is provided with a front side frame and a rear side frame arranged, spaced at a distance, in the back-and-forth direction, a support member that couples said frames together, and a conveying belt mechanism arranged between said frames, and is positioned under said support frame, spaced at a distance;

said floating support means that supports said conveying unit includes two substantially the same rear floating support mechanisms that support at least two places of said rear side frame of said conveying unit, as well as a front floating support mechanism that supports at least one place of said front side frame;

said front floating support mechanism includes a coupling protrusion that is so formed as to extend substantially horizontally toward said front side frame of said conveying unit, a collar which is fitted in a hole formed in said coupling protrusion to move in the axial direction thereof, and a support bolt that penetrates through the hole of said collar to move in the axial direction thereof relative thereto and that is detachably screwed at its upper end into said support frame and that has a head portion at the lower end thereof;

said collar has at its upper end an annular flange of a diameter larger than that of a cylindrical portion that fits into said hole of said coupling protrusion and is prevented from downwardly moving beyond said coupling protrusion, and a spring means is arranged between the upper end of said collar and said support frame to downwardly urge said front side frame at all times via said collar and said coupling protrusion;

said support bolt has an annular position-restricting flange formed over said head portion, spaced at a distance, in the axial direction, the outer diameter of said position-restricting flange restricts the downward movement of said collar on said support bolt and is so selected as to be movably fitted into said hole of said coupling protrusion, and the outer diameter of said head portion is selected to be movably fitted to said hole of said coupling protrusion;

a stop ring member having a portion which is greater in the radial direction than said position-restricting flange is detachably fitted between said head portion of said support bolt and said position-restricting flange without being allowed to move in the axial direction;

when said support frame is at the closed position, the lower surface of said coupling protrusion of said front side frame is so positioned as to maintain a predetermined gap with respect to the upper surface of said stop ring member; and when said support frame is upwardly opened by a predetermined angle from the closed position via said hinge means, said spring means extends and the lower surface of said coupling protrusion comes in contact with the upper surface of said stop ring member, such that said front side frame is supported by said support frame.

7. An automatic document feeder according to claim 6, where:

said stop ring member is made of an elastic material of a synthetic resin, and has an annular flat base portion with its one end being cut away at a predetermined distance, and a protrusion that extends in an L-shape from the end of said flat base portion of the side opposite to said cut-away portion.

8. An automatic document feeder according to claim 1, wherein:

said conveying unit is provided with a front side frame and a rear side frame that are arranged, spaced at a distance, in the back-and-forth direction, a support member for coupling said frames together, and a conveying belt mechanism disposed between said frames;

said support member is constituted by a plurality of channel-like members of which both ends are secured to said front side frame and to said rear side frame;

a notch is formed at both ends of said support member; and said spacer means provided for said conveying unit is constituted by contact pieces of substantially the same L-shape secured to the upper surface near said notches of said support member, and the lower ends of said contact pieces downwardly protrude through said notches.

9. An automatic document feeder according to claim 1, wherein either said paper feeding unit or said paper discharging unit is provided with a front side plate and a rear side plate, and said spacer means provided for either said paper feeding unit or said paper discharging unit at said lower portion on the side opposite to said hinge means is constituted by contact pieces that are so secured as to downwardly protrude from the lower portions of said front side plate of either one of said units.

* * * * *